US011491793B2

(12) United States Patent
Hamamoto

(10) Patent No.: US 11,491,793 B2
(45) Date of Patent: Nov. 8, 2022

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventor: Seiko Hamamoto, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/172,229

(22) Filed: Feb. 10, 2021

(65) Prior Publication Data

US 2021/0252865 A1 Aug. 19, 2021

(30) Foreign Application Priority Data

Feb. 13, 2020 (JP) ..... JP2020-022154

(51) Int. Cl.
*B41J 2/165* (2006.01)

(52) U.S. Cl.
CPC .... *B41J 2/16544* (2013.01); *B41J 2002/1657* (2013.01); *B41J 2002/16573* (2013.01); *B41P 2235/20* (2013.01)

(58) Field of Classification Search
CPC ..... B41J 2/16544; B41J 2002/1657; B41J 2002/16573; B41P 2235/20
See application file for complete search history.

(56) References Cited

U.S. PATENT DOCUMENTS

2006/0066664 A1 3/2006 Kachi et al.
2006/0066665 A1 3/2006 Kachi et al.
2020/0016893 A1* 1/2020 Ono ..... B41J 2/16517

FOREIGN PATENT DOCUMENTS

JP 2006095815 A 4/2006
JP 2006095880 A 4/2006
JP 2006095881 A 4/2006
JP 2006102972 A 4/2006
JP 2006224360 A 8/2006
JP 2006224361 A 8/2006
JP 2017052191 A * 3/2017

* cited by examiner

*Primary Examiner* — Sharon Polk
(74) *Attorney, Agent, or Firm* — Chip Law Group

(57) ABSTRACT

A liquid ejecting apparatus includes a liquid ejecting head having a nozzle surface and configured to eject liquid from a nozzle formed at the nozzle surface, a wiper configured to perform wiping with respect to the nozzle surface, a condition detection unit configured to detect the inner condition of a pressure chamber communicating with the nozzle, and a control unit configured to change wiping conditions for wiping the nozzle surface by using the wiper in accordance with the detected inner condition of the pressure chamber.

12 Claims, 12 Drawing Sheets

LIQUID EJECTING APPARATUS AND MAINTENANCE METHOD FOR LIQUID EJECTING APPARATUS

The present application is based on, and claims priority from JP Application Serial Number 2020-022154, filed Feb. 13, 2020, the disclosure of which is hereby incorporated by reference herein in its entirety.

BACKGROUND

1. Technical Field

The present disclosure relates to a liquid ejecting apparatus and a maintenance method for the liquid ejecting apparatus.

2. Related Art

JP-A-2006-95815 discloses a known liquid ejecting apparatus including a liquid ejecting head having a nozzle for ejecting liquid, a cleaning means for cleaning the nozzle, and a wiping member for wiping a nozzle surface at which the nozzle is provided. The liquid ejecting apparatus is configured to change the contact extent of the wiping member with the nozzle surface in accordance with the calculated cleaning success or failure rate.

However, the apparatus described above does not use any definite standard to change the contact extent, which makes it difficult to determine whether to increase or decrease the contact extent; and accordingly, the contact extent cannot be effectively changed.

SUMMARY

A liquid ejecting apparatus includes a liquid ejecting head having a nozzle surface and configured to eject liquid from a nozzle formed at the nozzle surface, a wiper configured to perform wiping with respect to the nozzle surface, a contact extent changing unit configured to change the contact extent of the wiper with respect to the nozzle surface, a moving unit configured to relatively move the wiper and the nozzle surface in a direction in which the wiping is performed, a condition detection unit configured to detect the inner condition of a pressure chamber communicating with the nozzle, and a control unit configured to change the contact extent by operating the contact extent changing unit in accordance with the inner condition of the pressure chamber detected by the condition detection unit.

A maintenance method is used for a liquid ejecting apparatus including a liquid ejecting head having a nozzle surface and configured to eject liquid from a nozzle formed at the nozzle surface and a wiper configured to perform wiping with respect to the nozzle surface. The maintenance method includes changing the contact extent of the wiper with respect to the nozzle surface in accordance with the inner condition of a pressure chamber communicating with the nozzle.

DESCRIPTION OF EXEMPLARY EMBODIMENTS

First, the structure of a liquid ejecting apparatus 11 will be described. The liquid ejecting apparatus 11 is an ink jet printer for printing by ejecting ink, which is an example of liquid, onto a medium 12 such as paper.

Figure 1:
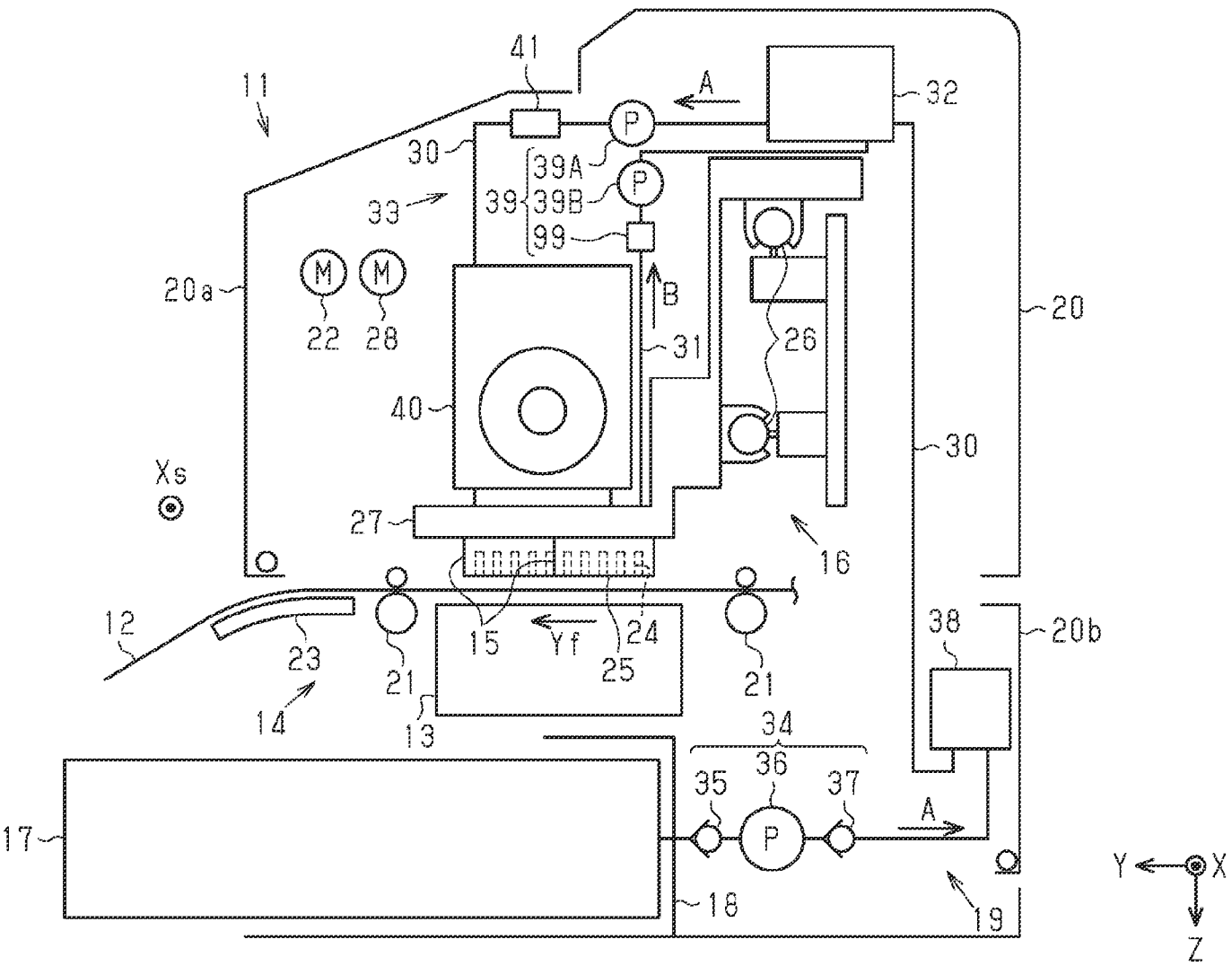
FIG. 1 is a side view schematically illustrating a liquid ejecting apparatus.

In FIG. 1, on the assumption that the liquid ejecting apparatus 11 is mounted on a horizontal plane, the Z axis indicates the direction of gravity, and the X-axis and the Y axis indicate directions along the horizontal plane. The X axis, Y axis, and Z axis are perpendicular to each other. In the following description, the direction parallel to the Z axis is referred to as the vertical direction.

As illustrated in FIG. 1, the liquid ejecting apparatus 11 includes a support table 13 for supporting the medium 12 and a transport unit 14 for transporting the medium 12. The liquid ejecting apparatus 11 also includes a liquid ejecting head 15 for ejecting liquid toward the medium 12 supported by the support table 13 and a movement mechanism 16 configured to move the liquid ejecting head 15 in a scan direction Xs.

The liquid ejecting apparatus 11 also includes a mounting unit 18 to which a liquid supply source 17 storing liquid is detachably attached and a liquid supply unit 19 configured to supply the liquid to the liquid ejecting head 15. The liquid ejecting apparatus 11 also includes a main body 20 composed of a housing, a frame, and the like, and a first cover 20*a* and a second cover 20*b* attached to the main body 20 in an openable and closable manner.

In the liquid ejecting apparatus 11, the support table 13 extends in the scan direction Xs, which is the width direction of the medium 12. The scan direction Xs of the present embodiment is a direction parallel to the X axis. The support table 13 supports the medium 12 positioned at the print position.

The transport unit 14 includes a transport roller pair 21 for transporting the medium 12 while pinching the medium 12, a transport motor 22 for rotating the transport roller pair 21, and a guide plate 23 for guiding the medium 12. A plurality of transport roller pairs 21 may be provided along the transport path of the medium 12. By driving the transport motor 22, the transport unit 14 transports the medium 12 along the surface of the support table 13. The transport unit 14 transports the medium 12 in a transport direction Yf. The transport direction Yf is a direction along the transport path of the medium 12 and is also a direction along the surface of the support table 13 in contact with the medium 12. The transport direction Yf of the present embodiment is parallel to the Y axis at the print position.

The liquid ejecting apparatus 11 of the present embodiment includes two liquid ejecting heads 15. The two liquid ejecting heads 15 are spaced apart from each other by a given distance in the scan direction Xs and shifted from each other by a given distance in the transport direction Yf. The liquid ejecting head 15 has a nozzle surface 25 on which a nozzle 24 is disposed. The liquid ejecting head 15 of the present embodiment ejects liquid in the vertical direction Z from the nozzle 24 toward the medium 12 positioned at the print position to print on the medium 12.

The movement mechanism 16 includes a guide shaft 26 elongated in the scanning direction Xs, a carriage 27 supported by the guide shaft 26, and a carriage motor 28 for moving the carriage 27 along the guide shaft 26. The carriage 27 holds the liquid ejecting head 15 in a manner in which the nozzle surface 25 faces the support table 13 in the vertical direction Z. The first cover 20*a* may cover a part of the movement path of the liquid ejecting head 15. In the liquid ejecting apparatus 11, by providing the liquid ejecting head 15 and the first cover 20*a* to enable the liquid ejecting head 15 to be exposed outside when the first cover 20*a* is open, the liquid ejecting head 15 can be easily replaced.

The movement mechanism 16 forces the carriage 27 and the liquid ejecting head 15 to reciprocate along the guide shaft 26 in the scan direction Xs and a direction opposite to the scan direction Xs. This means that the liquid ejecting apparatus 11 of the present embodiment is configured as a serial printer apparatus in which the liquid ejecting head 15 reciprocates along the X axis.

The liquid supply source 17 is, for example, a container for containing liquid. The liquid supply source 17 may be a replaceable cartridge or a refillable tank. The liquid ejecting apparatus 11 may include a plurality of liquid supply units 19 to supply different kinds of liquid to be ejected from the liquid injection head 15. The liquid ejecting apparatus 11 of the present embodiment includes four liquid supply units 19.

The liquid supply unit 19 includes a liquid storage unit 32 for storing liquid, a liquid supply channel 30 for supplying the liquid stored in the liquid storage unit 32 to the liquid ejecting head 15, and a liquid return channel 31 for returning to the liquid storage unit 32 the liquid supplied to the liquid ejecting head 15. The liquid supply channel 30 may couple the liquid storage unit 32 or the liquid supply source 17 to the liquid ejecting head 15. The liquid storage unit 32 of the present embodiment is provided at some midpoint of the liquid supply channel 30 coupling the liquid supply source 17 and the liquid ejecting head 15. The liquid return channel 31 may couple the liquid ejecting head 15 to the liquid storage unit 32 or an upstream position of the liquid supply channel 30 with respect to the liquid storage unit 32 in a supply direction A. This means that the liquid return channel 31 may couple the liquid ejecting head 15 and the liquid storage unit 32 via a part of the liquid supply channel 30. The liquid return channel 31 and the liquid supply channel 30 can together form a circulation channel 33.

The liquid supply unit 19 includes an outflow pump 34 for pumping liquid out of the liquid supply source 17. The outflow pump 34 includes a suction valve 35, a displacement pump 36, and a delivery valve 37. The suction valve 35 is positioned upstream with respect to the displacement pump 36 in the liquid supply channel 30 in the supply direction A. The delivery valve 37 is positioned downstream with respect to the displacement pump 36 in the liquid supply channel 30 in the supply direction A. The suction valve 35 and the delivery valve 37 enable liquid to flow from the upstream side to the downstream side in the liquid supply channel 30 and also prevent liquid to flow from the downstream side to the upstream side.

The liquid supply unit 19 includes a filter unit 38 for capturing air bubbles and foreign matters in liquid. The filter unit 38 may be detachably installed in the liquid supply channel 30. In the liquid ejecting apparatus 11, by providing the filter unit 38 and the second cover 20*b* to enable the filter unit 38 to be exposed outside when the second cover 20*b* is open, the filter unit 38 can be easily replaced. The filter unit 38 can be positioned between the outflow pump 34 and the liquid storage unit 32 in the liquid supply channel 30. The liquid return channel 31 can be coupled between the outflow pump 34 and the filter unit 38 in the liquid supply channel 30.

The liquid supply unit 19 includes a channel flow mechanism 39 configured to cause liquid to flow within the liquid supply channel 30 and the liquid return channel 31, a degassing module 41 provided in the liquid supply channel 30, and a pressure regulator device 40 for regulating the pressure on liquid supplied to the liquid ejecting head 15. The channel flow mechanism 39 includes a supply pump 39A provided in the liquid supply channel 30, a return pump 39B provided in the liquid return channel 31, and a return valve 99. The supply pump 39A can cause liquid in the liquid supply channel 30 to flow from the liquid storage unit 32 to the liquid ejecting head 15 in the supply direction A. The return pump 39B can cause liquid in the liquid return channel 31 to flow from the liquid ejecting head 15 to the liquid storage unit 32 in a return direction B. The return valve 99 can adjust the area of the cross-section of the passage of the liquid return channel 31 by controlling the degree of valve lift.

Figure 2:
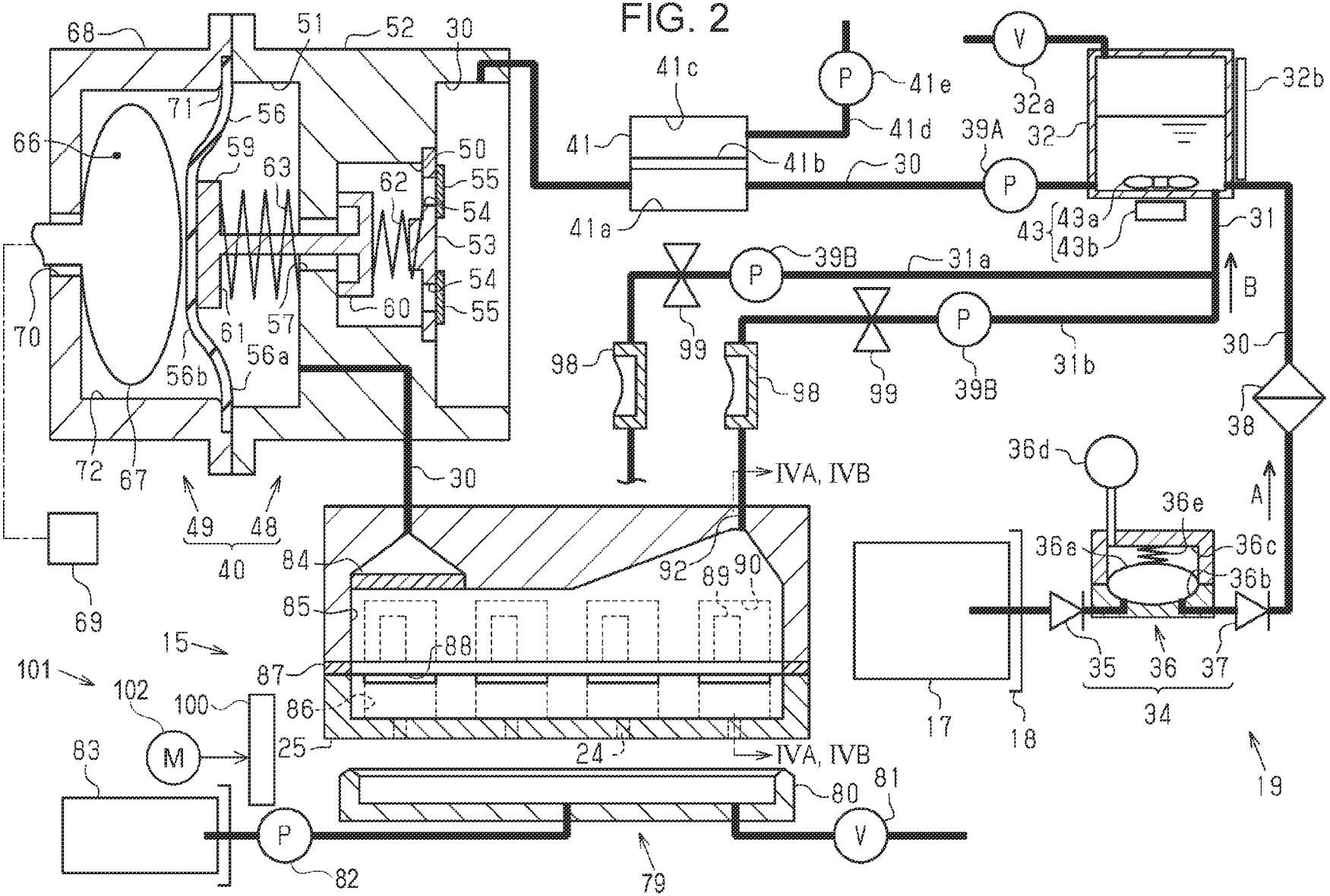
FIG. 2 is a sectional view schematically illustrating a liquid ejecting head and a liquid supply unit.

As illustrated in FIG. 2, the degassing module 41 includes a degassing chamber 41*a* for temporarily storing liquid, a decompression chamber 41*c* separated from the degassing chamber 41*a* by a degassing membrane 41*b*, a decompression channel 41*d* coupled to the decompression chamber 41*c*, and a vacuum degree adjustment mechanism 41*e* configured to adjust the vacuum degree in the degassing module 41. The degassing membrane 41*b* has a property of allowing gas to pass through but not liquid to pass through. The vacuum degree adjustment mechanism 41*e* is a pump configured to adjust the vacuum degree in the decompression chamber 41*c* by adjusting the internal pressure of the decompression chamber 41*c* with the use of the decompression channel 41*d*. As the pressure in the decompression chamber 41*c* decreases along with the operation of the vacuum degree adjustment mechanism 41*e*, the vacuum degree in the decompression chamber 41*c* increases. The vacuum degree in the degassing chamber 41*a* is adjusted in accordance with the vacuum degree in the decompression chamber 41*c*, and as a result, air bubbles, dissolved gas, and the like mixed in the liquid stored in the degassing chamber 41*a* are removed.

The displacement pump 36 includes a pump chamber 36*b* sectioned by a flexible member 36*a* and a negative pressure chamber 36*c*. The displacement pump 36 includes a decompression unit 36*d* for decompressing the negative pressure chamber 36*c* and a pressing member 36*e* provided in the negative pressure chamber 36*c* and used for pressing the flexible member 36*a* toward the pump chamber 36*b* side.

The outflow pump 34 sucks liquid from the liquid supply source 17 through the suction valve 35 along with the increase in the volume of the pump chamber 36*b*. The outflow pump 34 apply pressure to liquid by using the pressing member 36*e* pressing the liquid in the pump chamber 36*b* via the flexible member 36*a*. The outflow pump 34 outputs liquid toward the liquid ejecting head 15 via the delivery valve 37 along with the decrease in the volume of the pump chamber 36*b*. The pressure force applied to liquid by the outflow pump 34 is set in accordance with the pressing force of the pressing member 36*e*.

The liquid supply unit 19 includes a storage open valve 32*a* for opening the space in the liquid storage unit 32 to the atmosphere, a stored amount detection unit 32*b* for detecting the amount of liquid stored in the liquid storage unit 32, and an agitation mechanism 43 configured to agitate liquid in the liquid storage unit 32. The agitation mechanism 43 includes an agitator 43*a* provided in the liquid storage unit 32 and a rotation unit 43*b* for rotating the agitator 43*a*.

Next, the pressure regulator device 40 will be described. As illustrated in FIG. 2, the pressure regulator device 40 includes a pressure regulation mechanism 48 constituting a part of the liquid supply channel 30 and a pressing mechanism 49 for pressing the pressure regulation mechanism 48. The pressure regulation mechanism 48 includes a main body 52 having a liquid inflow unit 50 for receiving liquid supplied from the liquid supply source 17 through the liquid supply channel 30 and a liquid outflow unit 51 configured to store liquid.

The liquid supply channel 30 and the liquid inflow unit 50 are partitioned by a wall 53 included in the main body 52 and communicate with each other via a through-hole 54 formed at the wall 53. A filter member 55 covers the through-hole 54. As a result, the liquid in the liquid supply channel 30 is filtered by the filter member 55 and flows into the liquid inflow unit 50.

A diaphragm 56 constitutes at least a part of a wall surface of the liquid outflow unit 51. A first face 56*a* of the diaphragm 56 serves as an inner surface of the liquid outflow unit 51. The first face 56*a* receives pressure of the liquid in the liquid outflow unit 51. A second face 56*b* of the diaphragm 56 serves as an outer surface of the liquid outflow unit 51. The second face 56*b* receives atmospheric pressure. Thus, the position of the diaphragm 56 changes in accordance with the pressure in the liquid outflow unit 51. The capacity of the liquid outflow unit 51 alters as the position of the diaphragm 56 changes. The liquid inflow unit 50 and the liquid outflow unit 51 communicate with each other through a communication path 57.

The pressure regulation mechanism 48 includes an on-off valve 59 for switching between a close state in which the valve is closed to block the communication of the liquid inflow unit 50 and the liquid outflow unit 51 through the communication path 57 and an open state in which the valve is opened to enable the communication of the liquid inflow unit 50 and the liquid outflow unit 51. The on-off valve 59 illustrated in FIG. 2 is in the close state. The on-off valve 59 includes a valve section 60 configured to block the communication path 57 and a pressure receive section 61 for receiving pressure from the diaphragm 56. The on-off valve 59 moves when the diaphragm 56 pushes the pressure receive section 61.

An upstream pressing member 62 is provided in the liquid inflow unit 50. A downstream pressing member 63 is provided in the liquid outflow unit 51. Both the upstream pressing member 62 and the downstream pressing member 63 press the on-off valve 59 in a direction that enables the on-off valve 59 to be closed. The on-off valve 59 switches from the close state to the open state when the pressure on the first face 56*a* is lower than the pressure on the second face 56*b* and the difference between the pressure on the first face 56*a* and the pressure on the second face 56*b* is equal to or greater than a particular value. The particular value is, for example, 1 kPa.

The particular value is determined in accordance with the pressing force of the upstream pressing member 62, the pressing force of the downstream pressing member 63, the force required to change the position of the diaphragm 56, the seal load as the pressing force required to cause the valve section 60 to block the communication path 57, the pressure in the liquid inflow unit 50 acting on a surface of the valve section 60, and the pressure in the liquid outflow unit 51. Hence, as the pressing force of the upstream pressing member 62 and the pressing force of the downstream pressing member 63 increase, the particular value used to switch from the close state to the open state also increases.

The pressing force of the upstream pressing member 62 and the pressing force of the downstream pressing member 63 are set such that the pressure in the liquid outflow unit 51 is negative in a range that enables a meniscus to be formed at the gas-liquid interface of the nozzle 24. For example, when the pressure on the second face 56*b* is atmospheric pressure, the pressing force of the upstream pressing member 62 and the pressing force of the downstream pressing member 63 are set such that the pressure in the liquid outflow unit 51 is −1 kPa. In this case, the gas-liquid interface is a boundary at which liquid and gas are in contact with each other; the meniscus is a curved surface of liquid formed as a result of contact between the liquid and the nozzle 24. It is preferable that a concave meniscus suitable for ejecting liquid be formed in the nozzle 24.

In the present embodiment, when in the pressure regulation mechanism 48 the on-off valve 59 is in the close state, the pressure of the liquid upstream with respect to the pressure regulation mechanism 48 is normally controlled to be positive pressure by the outflow pump 34 and the channel flow mechanism 39. More specifically, when the on-off valve 59 is in the close state, the pressure of the liquid in the liquid inflow unit 50 and the liquid upstream with respect to the liquid inflow unit 50 is normally controlled to be positive pressure by the outflow pump 34 and the channel flow mechanism 39.

In the present embodiment, when in the pressure regulation mechanism 48 the on-off valve 59 is in the close state, the pressure of the liquid downstream with respect to the pressure regulation mechanism 48 is normally controlled to be negative pressure by the diaphragm 56. More specifically, when the on-off valve 59 is in the close state, the pressure of the liquid in the liquid outflow unit 51 and the liquid downstream with respect to the liquid outflow unit 51 is normally controlled to be negative pressure by the diaphragm 56.

When the liquid ejecting head 15 ejects liquid, the liquid stored in the liquid outflow unit 51 is supplied to the liquid ejecting head 15 through the liquid supply channel 30. As a result, the pressure in the liquid outflow unit 51 decreases. When, as for the diaphragm 56, the difference between the pressure on the first face 56*a* and the pressure on the second face 56*b* accordingly becomes equal to or greater than the particular value, the diaphragm 56 is bent so as to reduce the capacity of the liquid outflow unit 51. Due to this deformation of the diaphragm 56, the diaphragm 56 pushes the pressure receive section 61 to move, and as a result, the on-off valve 59 switches into the open state.

When the on-off valve 59 switches into the open state, since pressure is being applied to the liquid in the liquid inflow unit 50 by the outflow pump 34 and the channel flow mechanism 39, the liquid starts flowing from the liquid inflow unit 50 to the liquid outflow unit 51. As a result, the pressure in the liquid outflow unit 51 increases. When the pressure in the liquid outflow portion 51 increases, the diaphragm 56 is deformed so as to increase the volume of the liquid outflow unit 51. When the difference between the pressure applied to the first face 56*a* and the pressure applied to the second face 56*b* of the diaphragm 56 becomes smaller than the particular value, the on-off valve 59 changes from the open state to the close state. As a result, the on-off valve 59 inhibits the flow of the liquid flowing from the liquid inflow unit 50 toward the liquid outflow unit 51.

As described above, by adjusting the pressure of the liquid supplied to the liquid ejecting head 15 due to the displacement of the diaphragm 56, the pressure regulation mechanism 48 regulates the pressure in liquid ejecting head 15 as the back pressure of the nozzle 24.

The pressing mechanism 49 includes an expansion and contraction unit 67 forming a pressure regulation chamber 66 on the second face 56*b* side with respect to the diaphragm 56, a holder member 68 for holding the expansion and contraction unit 67, and a pressure regulation unit 69 configured to regulate the pressure in the pressure regulation chamber 66. The expansion and contraction unit 67 is formed in a balloon shape by using, for example, a rubber or a resin. The expansion and contraction unit 67 expands or contracts in conjunction with the adjustment of the pressure in the pressure regulation chamber 66 by the pressure regulation unit 69. The holder member 68 is formed in, for example, a bottomed cylindrical shape. A part of the expansion and contraction unit 67 is inserted in an insertion hole 70 formed at the bottom of the holder member 68.

An edge portion of the inner side surface of the holder member 68 on an opening 71 side is rounded by being shaped into a round chamfer. The holder member 68 is attached to the pressure regulation mechanism 48 such that the opening 71 is covered by the pressure regulation mechanism 48. As such, the holder member 68 forms an air chamber 72 covering the second face 56*b* of the diaphragm 56. It is assumed that the pressure in the air chamber 72 is atmospheric pressure. Accordingly, atmospheric pressure acts on the second face 56*b* of the diaphragm 56.

The pressure regulation unit 69 expands the expansion and contraction unit 67 by adjusting the pressure in the pressure regulation chamber 66 to a pressure higher than atmospheric pressure, which is the pressure in the air chamber 72. In the pressing mechanism 49, the pressure regulation unit 69 expands the expansion and contraction unit 67 to push the diaphragm 56 in a direction in which the capacity of the liquid outflow unit 51 decreases. At this time, the expansion and contraction unit 67 of the pressing mechanism 49 pushes a portion of the diaphragm 56 at which the pressure receive section 61 is in contact with the diaphragm 56. The portion of the diaphragm 56 at which the pressure receive section 61 is in contact with the diaphragm 56 is larger than the cross-section of the communication path 57.

Figure 3:
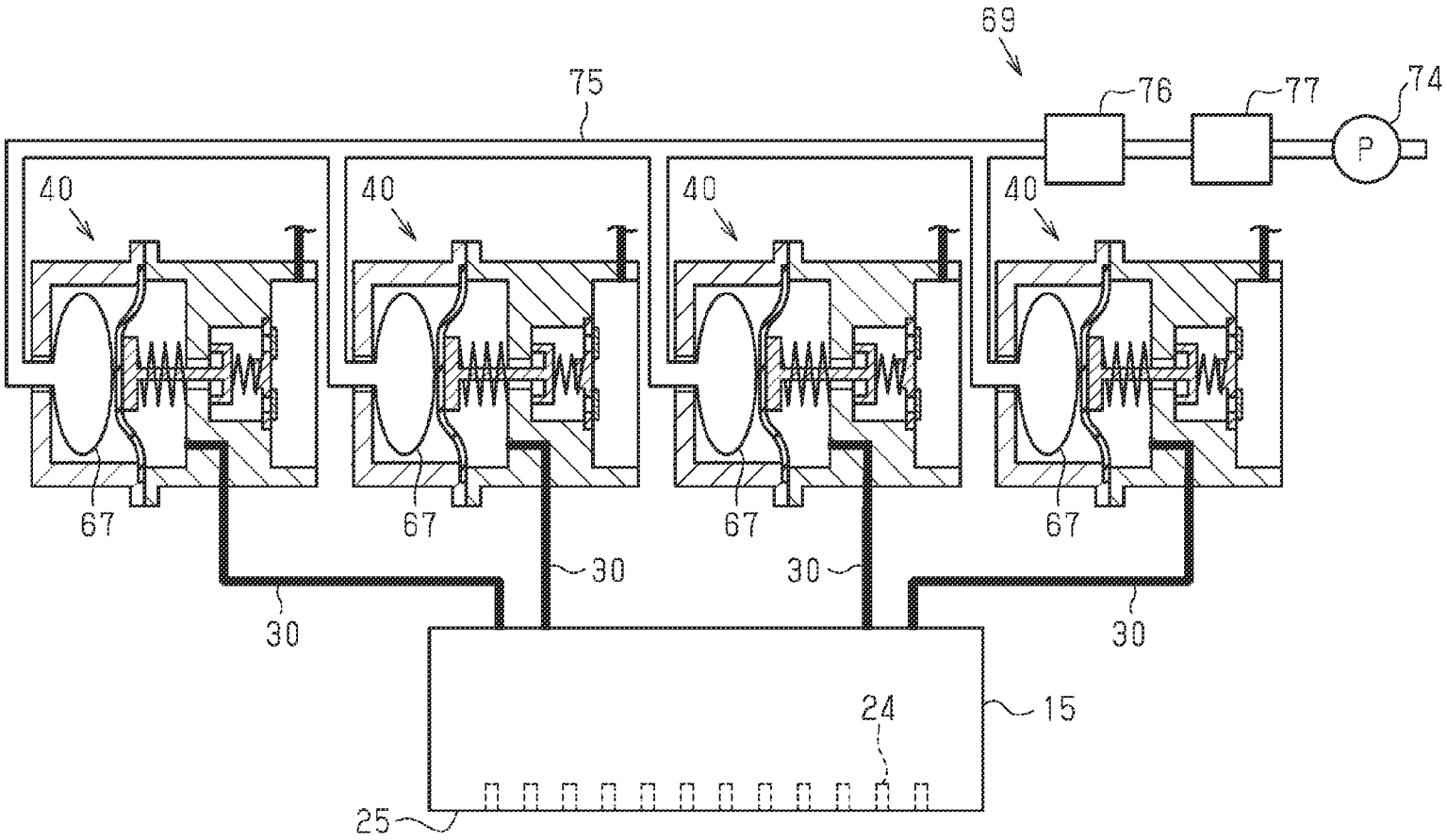
FIG. 3 is a sectional view schematically illustrating a plurality of pressure regulator devices and a pressure regulation unit.

As illustrated in FIG. 3, the pressure regulation unit 69 includes a pressure pump 74 for applying pressure to fluid such as air or water and a coupling path 75 coupling the pressure pump 74 and the expansion and contraction unit 67. The pressure regulation unit 69 also includes a pressure detection unit 76 for detecting the pressure of the fluid in the coupling path 75 and a fluid pressure regulation unit 77 for regulating the pressure of the fluid in the coupling path 75.

The coupling path 75 is divided into a plurality of branches; and each branch is coupled to the expansion and contraction unit 67 of the pressure regulator device 40, where a plurality of pressure regulator devices 40 are provided. The coupling path 75 of the present embodiment is divided into four branches; and each branch is coupled to the expansion and contraction unit 67 of the pressure regulator device 40, where four pressure regulator devices 40 are provided. The fluid pressurized by the pressure pump 74 is supplied to each expansion and contraction unit 67 through the coupling path 75. Valves for opening or closing the channel may be provided at respective branch points at which the coupling path 75 is divided into a plurality of branches. This structure enables pressurized fluid to be selectively supplied to a plurality of expansion and contraction units 67 by controlling the valves.

The fluid pressure regulation unit 77 may be implemented as, for example, an escape valve. The fluid pressure regulation unit 77 is configured to automatically open the valve when the pressure of the fluid in the coupling path 75 is higher than a predetermined pressure. When the fluid pressure regulation unit 77 opens, the fluid in the coupling path 75 flows downstream from the fluid pressure regulation unit 77. In this manner, the fluid pressure regulation unit 77 decreases the pressure of the fluid in the coupling path 75.

As illustrated in FIG. 2, the liquid ejecting apparatus 11 includes a maintenance unit 79. The maintenance unit 79 performs a maintenance process for restoring the function of ejecting liquid from the liquid ejecting head 15. The maintenance unit 79 includes a cap 80 configured to cap the nozzle surface 25 of the liquid ejecting head 15, a cap open valve 81 for opening the inside of the cap 80 to the atmosphere, a suction pump 82 for sucking the content inside the cap 80, and a waste liquid tank 83 for storing waste liquid.

The cap 80 moves relative to the liquid ejecting head 15 to perform capping. The capping is an operation of bringing the cap 80 into contact with the liquid ejecting head 15 to form a space in which the nozzle 24 is open. The cap 80 caps the nozzle surface 25 to prevent the liquid in the nozzle 24 from thickening due to drying.

In the state in which the cap 80 caps the nozzle surface 25, the cap 80 may form a closed space so as to prevent fluid such as gas and liquid from flowing out of the inside of the cap 80 or flowing into the inside of the cap 80. In this manner, the capping can further suppress the drying of the liquid in the nozzle 24.

The cap open valve 81 is a valve that enables communication between the inside of the cap 80 and the atmosphere outside the cap 80 by opening the valve while the cap 80 caps the liquid ejecting head 15.

The maintenance unit 79 may have a plurality of caps 80 in accordance with the number of liquid ejecting heads 15. The maintenance unit 79 of this embodiment has two caps 80. The two caps 80 respectively cap two liquid ejecting heads 15.

When the cap 80 is driven while the cap 80 caps the liquid ejecting head 15, the suction pump 82 exerts a negative pressure on the nozzle 24 to forcibly discharge liquid from the nozzle 24. The discharge of liquid from the nozzle 24 is also referred to as suction cleaning, which is an example of the maintenance process. The waste liquid tank 83 stores the liquid discharged by the suction cleaning as waste liquid. The waste liquid tank 83 may be replaceable.

The liquid ejecting apparatus 11 also includes a wiper 100 capable of wiping the nozzle surface 25 of the liquid ejecting head 15. The wiper 100 removes liquid on the nozzle surface 25 by wiping the nozzle surface 25, that is, sweeping the nozzle surface 25, for example, after the suction cleaning. The wiping the nozzle surface 25 is an example of the maintenance process.

The liquid ejecting apparatus 11 includes a moving unit 101 configured to relatively move in a direction in which the wiper 100 wipes the liquid ejecting head 15. In the present embodiment, a motor 102 for moving the wiper 100 relative to the liquid ejecting head 15 is provided. The wiper 100 moves in the wiping direction by being driven by the motor 102. As a result, the wiper 100 and the nozzle surface 25 move relative to each other.

Next, the liquid ejecting head 15 and the liquid return channel 31 will be described. As illustrated in FIG. 2, the liquid ejecting head 15 includes filter 84 for filtering the supplied liquid. The liquid ejecting head 15 ejects from the nozzle 24 the liquid filtered by the filter 84. The filter 84 captures air bubbles, foreign matters, and the like in the supplied liquid. The filter 84 may be provided at a common liquid chamber 85 coupled to the liquid supply channel 30.

The liquid ejecting head 15 includes a plurality of pressure chambers 86 in communication with the common liquid chamber 85. A plurality of nozzles 24 respectively communicates with the pressure chambers 86. A part of the wall surface of the pressure chamber 86 is formed by a vibrating plate 87. The common liquid chamber 85 and the pressure chambers 86 communicate with each other through a supply side communication path 88.

The liquid ejecting head 15 includes a plurality of actuators 89 and a plurality of housing chambers 90 for housing the actuators 89. The housing chambers 90 are arranged at positions different from the position of the common liquid chamber 85. One housing chamber 90 houses one actuator 89. At the vibrating plate 87, the actuators 89 are provided on the surface opposite to the portion facing the pressure chamber 86.

The actuator 89 of the present embodiment is constituted by a piezoelectric element that contracts when a drive voltage is applied. After the vibrating plate 87 is deformed along with the contraction of the actuator 89 due to the application of the drive voltage, when the application of the drive voltage to the actuator 89 is stopped, the liquid in the pressure chamber 86 with a changed capacity is ejected as droplets from the nozzle 24; in other words, the liquid ejecting head 15 ejects liquid from the nozzle 24 communicating with each pressure chamber 86 by pressurizing the liquid in the pressure chamber 86 with the use of the actuators 89.

Figure 4A:
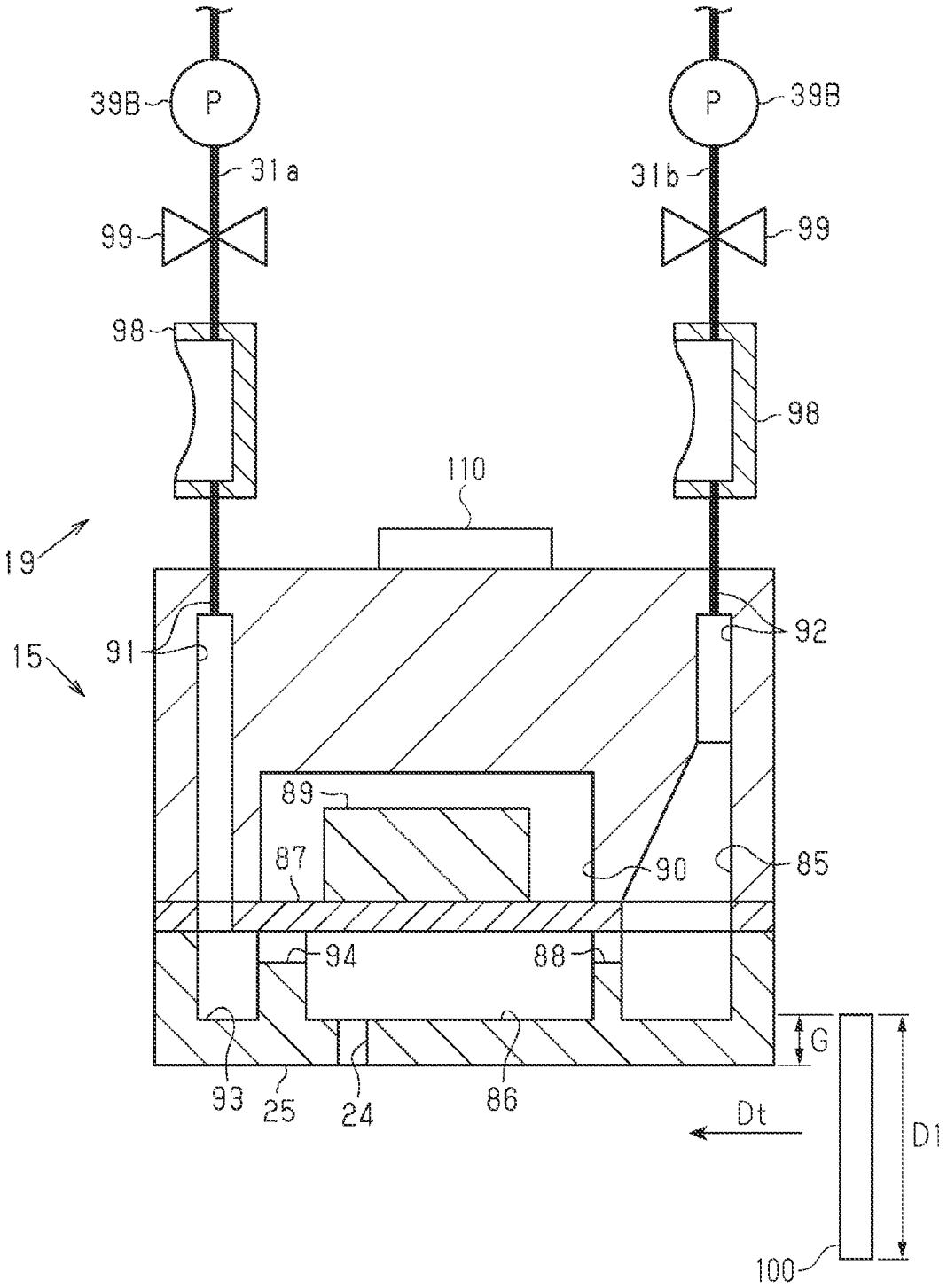
FIG. 4A is a sectional view taken along line IVA-IVA in FIG. 2.

As illustrated in FIG. 4A, the liquid ejecting head 15 may include a first discharge channel 91 and a second discharge channel 92 for discharging the supplied liquid outside without passage through the nozzle 24 and a discharged liquid chamber 93 coupling the first discharge channel 91 and the pressure chambers 86. The discharged liquid chamber 93 communicates with the plurality of pressure chambers 86 through a discharge side communication path 94 provided for each pressure chamber 86. By providing the discharged liquid chamber 93, it is sufficient to provide one first discharge channel 91 for the plurality of pressure chambers 86. This means, by providing the discharged liquid chamber 93, it is unnecessary to provide the first discharge channel 91 for each pressure chamber 86. This makes it possible to simplify the structure of the liquid ejecting head 15. The liquid ejecting head 15 may have a plurality of first discharge channels 91 communicating with the plurality of pressure chambers 86.

As illustrated in FIGS. 2 and 4A, the liquid return channel 31 may include a first return channel 31*a* coupled to the first discharge channel 91 and a second return channel 31*b* coupled to the second discharge channel 92. The liquid return channel 31 of the present embodiment is configured so that the first return channel 31*a* and the second return channel 31*b* merge together. In the liquid return channel 31, the first return channel 31*a* and the second return channel 31*b* do not necessarily merge together and each may be coupled to the liquid supply channel 30.

The first return channel 31*a* and the second return channel 31*b* may include a damper 98 and the return valve 99. The return pump 39B may be provided in each of the first feedback flow path 31*a* and the second feedback flow path 31*b*; alternatively, one return pump 39B may be provided in the liquid return channel 31 between a portion at which the first return channel 31*a* and the second return channel 31*b* merge together and a connection point to the liquid supply channel 30.

The damper 98 stores liquid. For example, one face of the damper 98 is formed of a flexible film, so that the capacity for storing liquid is variable. By providing the damper 98, it is possible to suppress changes in the pressure generated in the liquid ejecting head 15 when liquid flows through the first return channel 31*a* and the second return channel 31*b*.

In the first return channel 31*a*, the return valve 99 is positioned between the return pump 39B and the damper 98. In the second return channel 31*b*, the return valve 99 is positioned between the return pump 39B and the damper 98. The liquid supply unit 19 may flow liquid through any of the first return channel 31*a* and the second return channel 31*b* by opening or closing the return valve 99. The liquid supply unit 19 may control the valve lift of the return valve 99. The flow rate of the liquid flowing through the first return channel 31*a* and the flow rate of the liquid flowing through the second return channel 31*b* are determined in accordance with the valve lift of the corresponding return valve 99.

Figure 4B:
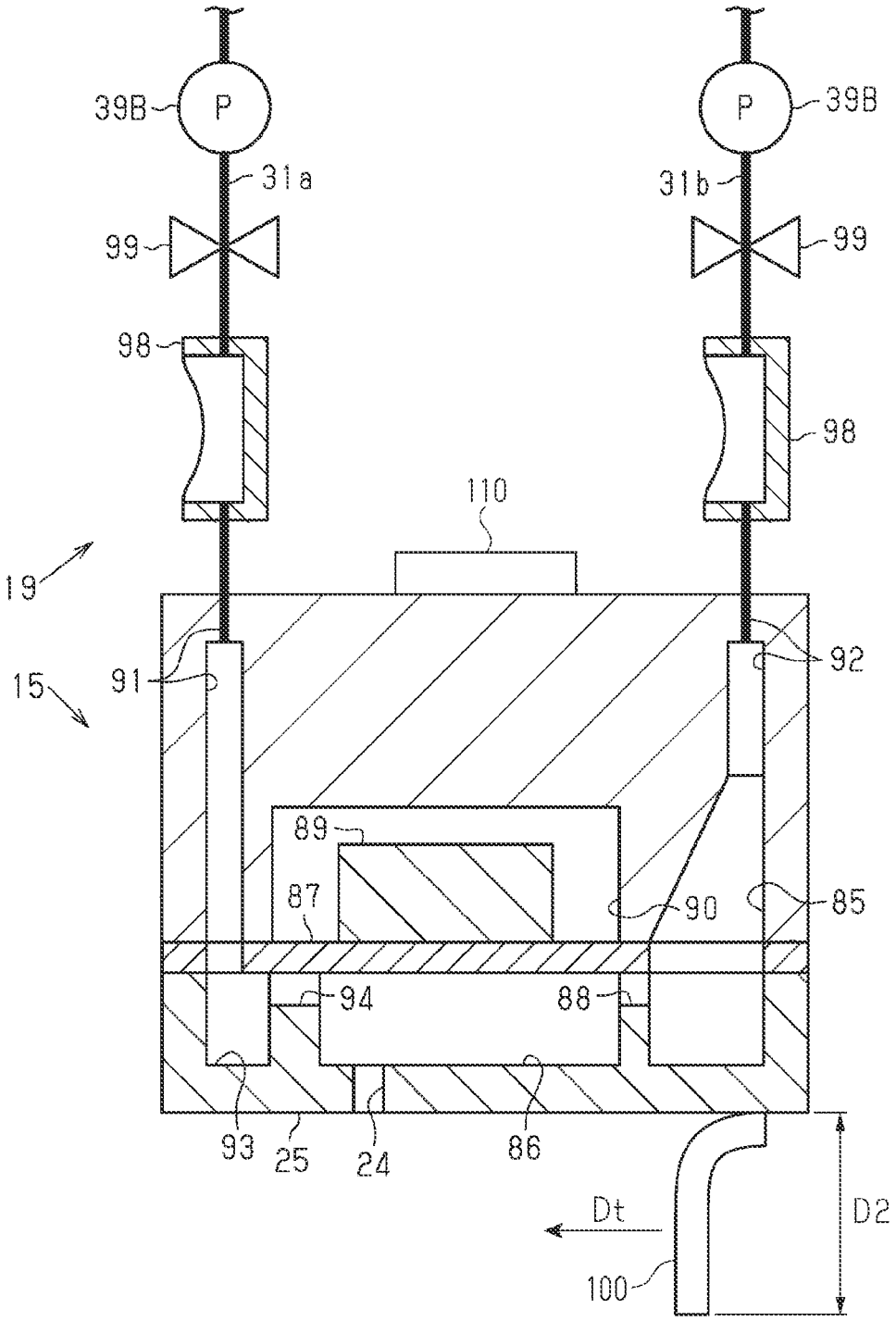
FIG. 4B is a sectional view taken along line IVB-IVB in FIG. 2.

Next, a contact extent G of the wiper 100 will be described. As illustrated in FIGS. 4A and 4B, the wiper 100 is shaped as a plate and is elastically deformable. When the motor 102 of the moving unit 101 is driven to move the wiper 100 in a wiping direction Dt in which wiping is performed with respect to the nozzle surface 25, wiping is performed in the state in which a distal end portion of the wiper 100 in contact with the nozzle surface 25 is elastically deformed. The wiping direction Dt is the horizontal direction.

The liquid ejecting apparatus 11 also includes a contact extent changing unit 110 configured to change the contact extent of the wiper 100 with respect to the nozzle surface 25 during wiping. The contact extent changing unit 110 of the present embodiment includes a motor. By driving the motor, the liquid ejecting head 15 can be moved up and down along the Z axis. In this manner, it possible to change the contact extent of the wiper 100 with the nozzle surface 25 during wiping.

FIG. 4A illustrate a state in which the wiper 100 is not wiping the nozzle surface 25. At this time, the height of the wiper 100 is D1. FIG. 4B illustrate a state in which the wiper 100 is wiping the nozzle surface 25. At this time, the wiper 100 is elastically deformed and the height of the wiper 100 is D2. Here, a difference G between the height D1 and the height D2 is referred to as the contact extent G of the wiper 100 with respect to the nozzle surface 25. In other words, the contact extent G is the difference G in a direction perpendicular to the nozzle surface 25 when the nozzle surface 25 is wiped by the wiper 100.

To achieve a sufficient wiping efficiency with respect to the nozzle surface 25 and increase the success rate of the maintenance process, it is necessary to set the contact extent G to an appropriate value. The contact extent G is an example of the wiping conditions. As will be described later, the liquid ejecting apparatus 11 is configured to set the contact extent G to an appropriate value by using the contact extent changing unit 110. The default setting of the contact extent G is, for example, 1 mm. The contact extent G can be changed in increments of 0.1 mm.

Further, the speed of movement of the wiper 100 relative to the nozzle surface 25 during wiping, the number of wiping times in one maintenance process, and the type of wiper 100 are also examples of the wiping conditions. The wiper 100 is defined by, for example, hardness and thickness; for example, the hardness of the wiper 100 is 40 degrees and the thickness in the wiping direction Dt is 1.5 mm. The wiper 100 is changed in increments of, for example, 5 degrees for hardness and 0.1 mm for thickness. The liquid ejecting apparatus 11 can select one wiper from a plurality of wipers 100 of different levels of hardness and thickness. The default setting of the speed of movement of the wiper 100 relative to the nozzle surface 25 is, for example, 10 mm/s. The speed can be changed in increments of 1 mm/s.

The default setting of the number of times of wiping in one maintenance process is, for example, one time. The number of times of wiping can be changed in increments of, for example, one time.

Figure 5:
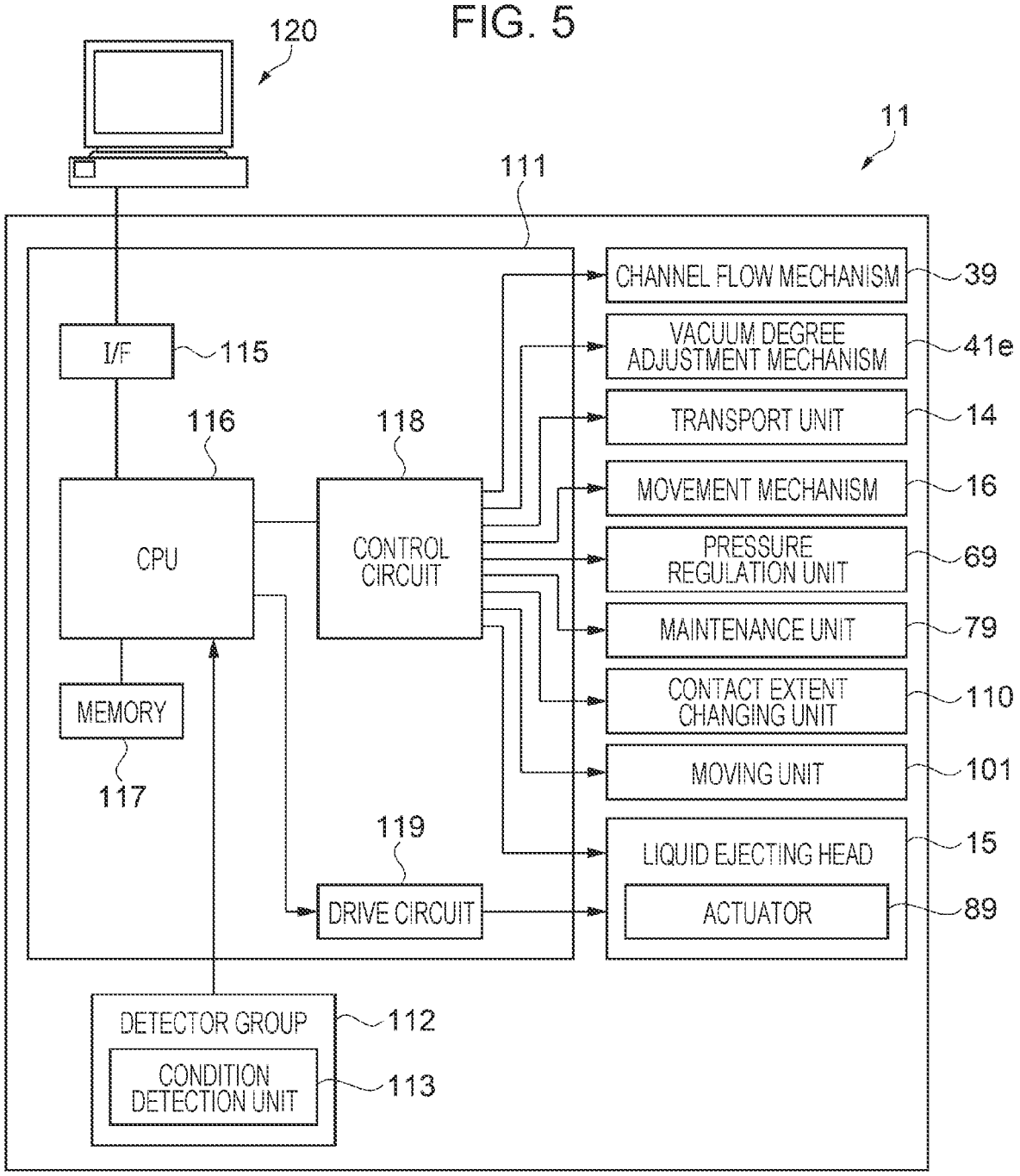
FIG. 5 is a block diagram illustrating an electrical configuration of the liquid ejecting apparatus.

Next, an electrical configuration of the liquid ejecting apparatus 11 will be described. As illustrated in FIG. 5, the liquid ejecting apparatus 11 includes a control unit 111 for comprehensively controlling constituent elements of the liquid ejecting apparatus 11 and a detector group 112 configured to be controlled by the control unit 111. The detector group 112 includes a condition detection unit 113 configured to detect the inner condition of the pressure chamber 86 by detecting the vibration waveform of the pressure chamber 86. The detector group 112 monitors the state of the liquid ejecting apparatus 11. The detector group 112 outputs the detection result to the control unit 111.

The control unit 111 includes an interface 115, a central processing unit (CPU) 116, a memory 117, a control circuit 118, and a drive circuit 119. The interface 115 communicates data between a computer 120, which is an external device, and the liquid ejecting apparatus 11. The drive circuit 119 generates a drive signal for driving the actuator 89.

The CPU 116 is an operation processing apparatus. The memory 117 is a storage device for securing an area for storing programs for the CPU 116, a work area, and the like. The memory 117 includes memory elements such as a random-access memory (RAM) and an electrically erasable programmable read-only memory (EEPROM). The CPU 116 controls the mechanisms of the liquid ejecting apparatus 11 by using the control circuit 118 in accordance with the programs stored in the memory 117.

The detector group 112 may include, for example, a linear encoder for detecting the movement condition of the carriage 27 and a medium detection sensor for detecting the medium 12. The condition detection unit 113 may be a circuit for detecting residual vibration of the pressure chamber 86. The control unit 111 changes the wiping conditions described later in accordance with the inner condition of the pressure chambers 86 detected by the condition detection unit 113. The condition detection unit 113 may include a piezoelectric element constituting the actuator 89.

Next, a method of detecting the inner condition of the pressure chambers 86 by using the condition detection unit 113 will be described. When a voltage is applied to the actuator 89 in accordance with a signal from the drive circuit 119, the vibrating plate 87 is bent. As a result, the pressure in the pressure chamber 86 is changed. Due to this pressure change, the vibrating plate 87 remains vibrating for a while. This vibration is called residual vibration. In accordance with the residual vibration, it is possible to detect the condition of an area including the pressure chamber 86 and the nozzle 24 communicating with the pressure chamber 86. Hence, the detection of the inner condition of the pressure chamber 86 of the present embodiment is the detection of residual vibration.

Figure 6:
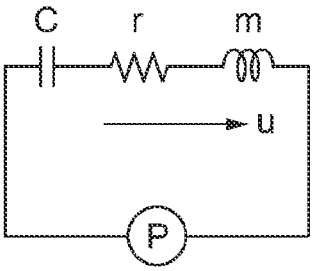
FIG. 6 illustrates a calculation model of simple harmonic motion as the simulation of residual vibration of a vibrating plate.

FIG. 6 illustrates a calculation model of simple harmonic motion as the simulation of residual vibration of the vibrating plate 87. When the drive circuit 119 outputs a drive signal to the actuator 89, the actuator 89 expands and contracts in accordance with the voltage of the drive signal. The vibrating plate 87 bends along with the expansion and contraction of the actuator 89. As such, the capacity of the pressure chamber 86 contracts after expanding. At this time, by the pressure generated in the pressure chamber 86, a part of the liquid occupying the pressure chamber 86 is ejected as droplets from the nozzle 24.

During the series of operation of the vibrating plate 87 described above, the vibrating plate 87 freely vibrates at a natural vibration frequency. The natural vibration frequency is determined by a channel resistance r, an inertance m, and a compliance C of the vibrating plate 87. The channel resistance r is determined by the shape of the channel in which liquid flows, the viscosity of liquid, and the like. The inertance m is determined by the weight of the liquid in the channel. The free vibration of the vibrating plate 87 is the residual vibration.

The calculation model of the residual vibration of the vibrating plate 87 can be expressed by using a pressure P, and the inertance m, the compliance C, and the channel resistance r described above. When the step response when the pressure P is applied to the circuit of FIG. 6 is calculated for the volume velocity u, the following equations can be obtained.

$$u = \frac{P}{\omega \cdot m} e^{-\omega t} \cdot \sin \omega t \tag{1}$$

$$\omega = \sqrt{\frac{1}{m \cdot c} - \alpha^2} \tag{2}$$

$$\alpha = \frac{r}{2m} \tag{3}$$

Figure 7:
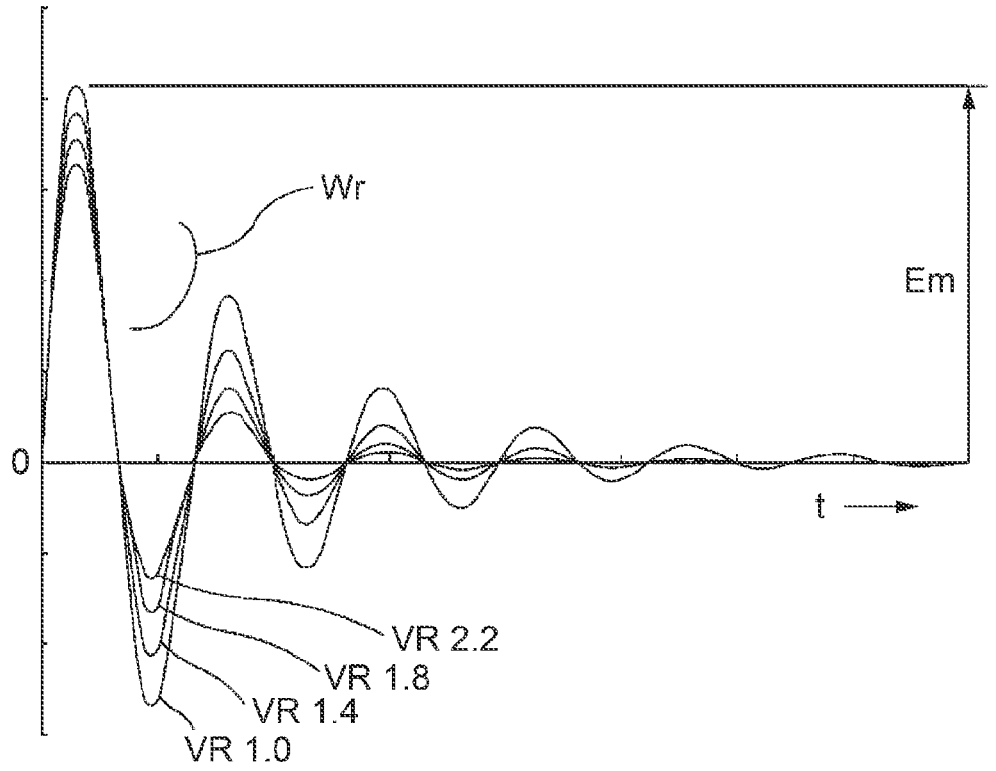
FIG. 7 is a graph for explaining a relationship between liquid thickening and vibration waveform.

FIG. 7 is a graph for explaining a relationship between liquid thickening and vibration waveform. The horizontal axis in FIG. 7 indicates time and the vertical axis indicates the magnitude of residual vibration. FIG. 7 illustrates vibration waveforms Wr corresponding to ink viscosity ratios VR 1.0, 1.4, 1.8, and 2.2. As illustrated in FIG. 7, for example, when the liquid near the nozzle 24 dries, the viscosity of the liquid increases, in other words, the liquid thickens. When the liquid thickens, the channel resistance r increases, and accordingly, the vibration cycle and the attenuation of the residual vibration increases.

Figure 8:
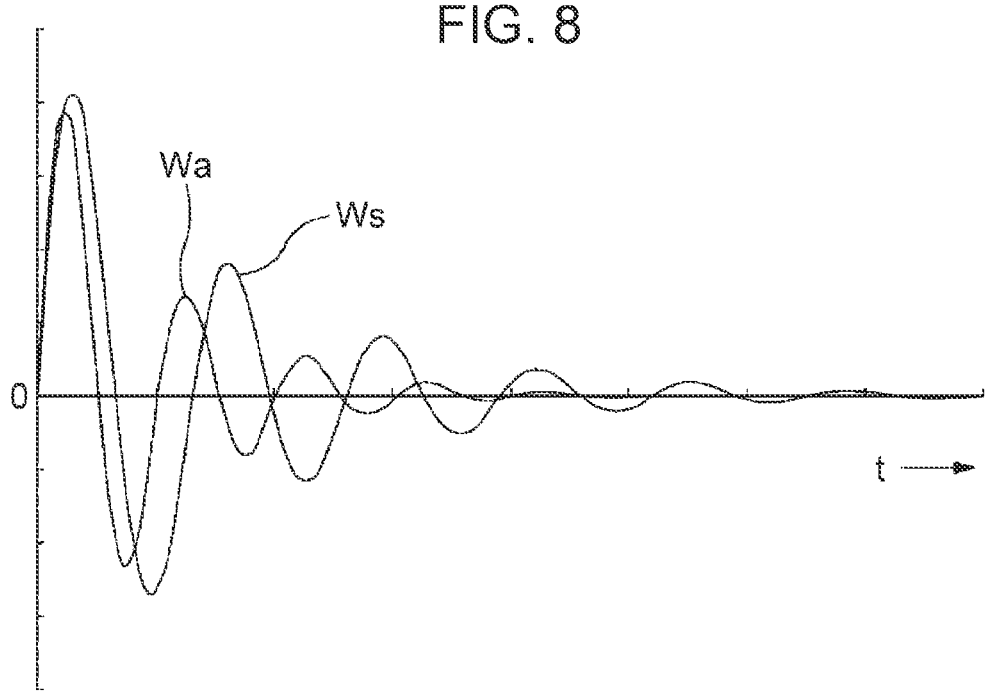
FIG. 8 is a graph for explaining a relationship between mixing of air bubbles and vibration waveform.

FIG. 8 is a graph for explaining a relationship between mixing of air bubbles and vibration waveform. The horizontal axis in FIG. 8 indicates time and the vertical axis indicates the magnitude of residual vibration. In FIG. 8, the vibration waveform in the normal time is indicated by Ws while the vibration waveform when air bubbles are mixed in is indicated by Wa. As illustrated in FIG. 8, for example, when air bubbles are mixed in the pressure chamber 86, the inertance m, which is the weight of liquid, is reduced by the amount of the air bubbles mixed in, in comparison to the case in which the nozzle 24 is in a normal state. According to Equation (2), when m decreases, the angular velocity w increases, and as a result, the vibration cycle shortens; in other words, the vibration frequency increases. The case in which air bubbles are mixed in the pressure chamber 86 denotes the case in which air bubbles are mixed in an area including the nozzle 24 in addition to the pressure chamber 86.

It is considered that, for example, when liquid is adhered to the nozzle surface 25 and the liquid adhered to the nozzle surface 25 is connected with the liquid in the nozzle 24, the liquid adhered to the nozzle surface 25 is further connected with the liquid occupying the pressure chamber 86 through the nozzle 24, and thus, the weight of liquid, that is, the inertance m increases because the amount of the liquid adhered to the nozzle surface 25 increases when viewed from the vibrating plate 87 as compared to the amount of the liquid the normal time. As a result, when the liquid adhered to the nozzle surface 25 is connected with the liquid in the pressure chamber 86, the frequency becomes lower than the frequency in the normal time.

Alternatively, when a foreign matter such as paper dust is stuck to the vicinity of the opening of the nozzle 24, the amount of the liquid in the pressure chamber 86 and the amount of the exuded liquid increases when viewed from the vibrating plate 87 as compared to the amount of the liquid in the normal time, and as a result, the inertance m increases. It is considered that the channel resistance r is increased by the fibers of the paper dust adhered to the vicinity of the outlet of the nozzle 24. As a result, when paper dust is adhered to the vicinity of the opening of the nozzle 24, the frequency is lower than the frequency during normal ejection, and the frequency of residual vibration is higher than the frequency in the case of thickening the liquid.

When the liquid is thickened, air bubbles are mixed in, or foreign matters are stuck, the inner condition of the nozzle 24 and the pressure chamber 86 becomes abnormal, and as a result, the liquid is usually not ejected from the nozzle 24. Thus, some dots are missed in the image printed on the medium 12. When droplets are ejected from the nozzle 24, the amount of the droplets may be small, or the travel direction of the droplets may shift and the droplets may not hit the target position. The nozzle 24 that causes ejection failure is referred to as an abnormal nozzle.

As described above, the residual vibration of the pressure chamber 86 communicating with an abnormal nozzle is different from the residual vibration of the pressure chamber 86 communicating with the normal nozzle 24. For this reason, the condition detection unit 113 detects the vibration waveform of the pressure chamber 86 to detect the inner condition of the pressure chamber 86.

The control unit 111 may evaluate whether the ejection condition of the liquid ejecting head 15 is normal or abnormal in accordance with the vibration waveform of the pressure chamber 86 that is the detection result of the condition detection unit 113. When the inner condition of the pressure chamber 86 is abnormal, it is assumed that the nozzle 24 communicating with the pressure chamber 86 is an abnormal nozzle. In accordance with the vibration waveform of the pressure chamber 86, the control unit 111 may determine whether the cause of the abnormality of the inner condition of the pressure chambers 86 is the presence of air bubbles or the thickening of the liquid. In accordance with the vibration waveform of the pressure chamber 86, the control unit 111 may estimate the total volume of air bubbles existing in the pressure chamber 86 and the nozzle 24 communicating with the pressure chamber 86, and also may determine the level of thickening of the liquid in the pressure chamber 86 and the nozzle 24 communicating with the pressure chamber 86. In accordance with the vibration waveform of the pressure chamber 86, the control unit 111 may evaluate whether the liquid is adhered to the nozzle surface 25 and whether the liquid adhered to the nozzle surface 25 and the liquid in the nozzle 24 are connected to each other.

The frequency of the vibration waveform detected in the state in which the pressure chamber 86 and the nozzle 24 filled with liquid contain air bubbles is higher than the frequency of the vibration waveform detected in the state in which the pressure chamber 86 and the nozzle 24 filled with liquid do not contain any air bubble. The frequency of the vibration waveform detected in the state in which the pressure chamber 86 and the nozzle 24 are filled with air is higher than the frequency of the vibration waveform detected in the state in which the pressure chamber 86 and the nozzle 24 filled with liquid contain air bubbles. Air bubbles in the pressure chamber 86 and the nozzle 24 filled with liquid become larger as they develop. The larger the size of air bubbles in the pressure chamber 86 and the nozzle 24 filled with liquid, the higher the frequency of the vibration waveform.

In the liquid ejecting apparatus 11, when liquid stops flowing, the liquid tends to thicken or air bubbles tend to accumulate. In this case, the nozzle tends to become abnormal; in other words, the inner condition of the pressure chambers 86 tends to become abnormal. Hence, the control unit 111 performs the maintenance process for maintaining the liquid ejecting head 15 for the purpose of suppressing the thickening of liquid in the liquid ejecting head 15 and of discharging air bubbles. The control unit 111 drives and controls the vacuum degree adjustment mechanism 41*e* in accordance with the detection result of the condition detection unit 113. The control unit 111 of the present embodiment is configured to perform a first operation, a second operation, a third operation, and a fourth operation as the maintenance process for the liquid ejecting head 15.

In the liquid ejecting head 15 during the recording process, the plurality of nozzles 24 may include inactive nozzles not ejecting liquid and active nozzles ejecting liquid because the active nozzles are used for recording while the inactive nozzles are not used for recording. In this case, as for the active nozzle and the pressure chamber 86 communicating with the active nozzle, liquid is ejected from the nozzle 24, and as a result, air bubbles are unlikely to appear or develop in the liquid and the liquid is unlikely to thicken. As for the inactive nozzle and the pressure chamber 86 communicating with the inactive nozzle, liquid stops flowing because the liquid is not ejected from the nozzle 24. As a result, in comparison to the pressure chambers 86 communicating with the active nozzle, air bubbles are likely to appear or develop in the liquid and the liquid is likely to thicken in the pressure chambers 86 communicating with the inactive nozzle. When the plurality of nozzles 24 include the inactive nozzles not ejecting liquid and the active nozzles ejecting liquid, the control unit 111 may target the pressure chambers 86 communicating with the inactive nozzles to perform the condition detection by the condition detection unit 113.

To suppress the thickening of liquid, flushing, which is an example of the maintenance process, is usually performed. By performing flushing while droplets are not being ejected from the nozzle 24 in the recording process, that is, while the carriage 27 is returning or during the time between sheets of the medium 12, it is possible to hinder the appearance and development of air bubbles in the liquid in the liquid ejecting head 15 and the thickening of the liquid. When flushing is performed, droplets are ejected from the nozzle 24, so that liquid is consumed. If flushing is often performed to hinder the appearance and development of air bubbles in the liquid and the thickening of the liquid during the recording process, a large amount of liquid is consumed. By performing the first, second, third, and fourth operations of the present embodiment, it is possible to reduce the frequency of ejecting droplets from the nozzle 24 for maintenance. As a result, it is possible to reduce the consumption of liquid due to maintenance.

As the maintenance process for the liquid ejecting head 15, the control unit 111 may perform the first operation of increasing the vacuum degree in the degassing module 41 by operating the vacuum degree adjustment mechanism 41*e*. The control unit 111 may increase the vacuum degree in the degassing module 41 by setting the vacuum degree in the degassing module 41 to a first vacuum degree V1 higher than a reference vacuum degree Vs. The control unit 111 may perform the first operation when it is predicted, in accordance with the detection result obtained by the condition detection unit 113, that the appearance of air bubbles and the development of air bubbles occur because the volume of air bubbles in the pressure chamber 86 is equal to or greater than a first set value. The first set value is recorded in the memory 117 of the control unit 111. For example, when the volume of the air bubbles in the pressure chamber 86 is equal to the first set value, the memory 117 may record the frequency of the vibration waveform detected by the condition detection unit 113.

When the volume of the air bubbles in the pressure chamber 86 is relatively small, the air bubbles may dissolve in the liquid and disappear over time. Further, the air bubbles in the pressure chamber 86 are more likely to dissolve in the liquid over time when the liquid around the air bubbles is flowing than when the liquid around the air bubbles is not flowing. When the volume of air bubbles is relatively small, for example, by waiting for a predetermined time, the air bubbles can be removed from the pressure chamber 86 without the first operation. By contrast, when the volume of the air bubbles in the pressure chamber 86 is relatively large, the air bubbles may develop over time. Thus, the first set value is a value indicating the smallest volume of air bubbles that cannot be expected to disappear over time.

In addition to the first operation of controlling the vacuum degree adjustment mechanism 41*e*, the control unit 111 may perform the second operation of operating the channel flow mechanism 39. In other words, when the appearance of air bubbles and the development of air bubbles are predicted in accordance with the detection result obtained by the condition detection unit 113, the control unit 111 may perform the second operation of operating the channel flow mechanism 39 in the state in which the first operation of adjusting the vacuum degree in the degassing module 41 is performed.

In the second operation, the control unit 111 may suck the liquid in the pressure chamber 86 from the liquid return channel 31 side so that the meniscus at the gas-liquid interface in the nozzle 24 is maintained, thereby causing the liquid to be discharged to the liquid return channel 31. In the second operation, the control unit 111 may apply pressure to the liquid in the pressure chamber 86 from the liquid supply channel 30 side to discharge the liquid to the liquid return channel 31. When the second operation is performed, the pressure in the pressure chamber 86 changes, so that the meniscus moves. The control unit 111 may perform the second operation in a manner that the movement of the meniscus is limited within the nozzle 24. When the meniscus moves toward the pressure chamber 86, the liquid in the nozzle 24 returns to the pressure chamber 86, such that it is possible to cause the liquid in the nozzle 24 to flow.

When it is predicted, in accordance with the detection result obtained by the condition detection unit 113, that the viscosity of the liquid in the pressure chambers 86 increases because the viscosity of the liquid in the pressure chambers 86 is equal to or greater than a second set value, the control unit 111 may perform the third operation as the maintenance process for the liquid ejecting head 15. The second set value is recorded in the memory 117 of the control unit 111. For example, when the viscosity of the liquid in the pressure chamber 86 is equal to the second set value, the memory 117 may record the frequency of the vibration waveform detected by the condition detection unit 113. The third operation is an operation of increasing the flow rate of the liquid flowing through the liquid supply channel 30 and the liquid return channel 31 by operating the channel flow mechanism 39 in the state in which the vacuum degree in the degassing module 41 is adjusted. The flow rate of liquid is the volume of flowing liquid per unit time. In the third operation, the control unit 111 may increase the flow rate of the liquid flowing in the liquid supply channel 30 and the liquid return channel 31 by a predetermined flow rate Fa. The predetermined flow rate Fa is defined such that, for example, when the flow rate of liquid is set to a particular flow rate larger than a reference flow rate Fs by the predetermined flow rate Fa, the particular flow rate is smaller than the maximum flow rate that can be set by the channel flow mechanism 39. In the third operation, the control unit 111 may increase the flow rate of the liquid flowing through the first return channel 31*a* and the second return channel 31*b* by enlarging the valve lift of the return valve 99.

In addition to the third operation of operating the channel flow mechanism 39, the control unit 111 may perform the fourth operation of operating the vacuum degree adjustment mechanism 41*e*. The fourth operation is an operation of decreasing the vacuum degree in the degassing module 41 by operating the vacuum degree adjustment mechanism 41*e*. In the fourth operation, the control unit 111 may decrease the vacuum degree in the degassing module 41 by setting the vacuum degree in the degassing module 41 to a second vacuum degree V2 lower than the reference vacuum degree Vs.

Next, a wiping condition setting process will be described. As described above, in the liquid ejecting apparatus 11, it is necessary to appropriately set the wiping conditions to achieve a sufficient wiping efficiency of the wiper 100 with respect to the nozzle surface 25 and increase the success rate of the maintenance process, that is, to reduce air bubbles in the pressure chamber 86 and the liquid on the nozzle surface 25 connected to the liquid in the nozzle 24 after wiping. Similarly, when the initial setting of the wiping conditions is performed, it is necessary to properly set the wiping conditions. To set the wiping conditions, it is necessary to clarify criteria for changing the wiping conditions and set the wiping conditions in an effective manner.

In the present embodiment, the control unit 111 changes the wiping conditions for wiping the nozzle surface 25 with the wiper 100 in accordance with the inner condition of the pressure chamber 86 detected by the condition detection unit 113. For example, the wiping conditions can be changed by comparing the detected inner condition of the pressure chamber 86 with a reference inner condition of the pressure chamber 86. As such, a criterion for changing the wiping conditions is clarified, and accordingly, the wiping conditions can be changed in an effective manner.

Here, the inner condition of the pressure chamber 86 includes whether air bubbles exist in the pressure chamber 86 and whether the liquid on the nozzle surface 25 is connected with the liquid in the nozzle 24. The detection of the inner condition of the pressure chamber 86 is performed such that the condition detection unit 113 detects the vibration waveform of the pressure chamber 86 caused to vibrate by the operation of the actuator 89. In accordance with the tendency of attenuation of the vibration waveform and the level of frequency of the vibration waveform, it is determined whether air bubbles exist in the pressure chamber 86 and whether the liquid on the nozzle surface 25 is connected with the liquid in the nozzle 24.

As the wiping conditions setting process, after the control unit 111 controls the wiping to be performed by using a first contact extent G1 as the contact extent G, when the control unit 111 determines, in accordance with the detected vibration waveform, that air bubbles exist in the pressure chamber 86, the control unit 111 changes the contact extent G to a second contact extent G2 smaller than the first contact extent G1. The change from the first contact extent G1 to the second contact extent G2 is performed by operating the contact extent changing unit 110. Specifically, the contact extent changing unit 110 is driven to raise the liquid ejecting head 15 along the Z axis. As a result, the nozzle surface 25 rises with respect to the wiper 100, so that the contact extent G can be decreased. For example, by raising the liquid ejecting head 15 by 0.1 mm along the Z axis, it is possible to change the contact extent G to the second contact extent G2 that is 0.1 mm smaller than the first contact extent G1.

Additionally, after the control unit 111 controls the wiping to be performed by using the first contact extent G1 as the contact extent G, when the control unit 111 determines, in accordance with the detected vibration waveform, that air bubbles develop or increase in the pressure chamber 86, the control unit 111 may change the contact extent G to a second contact extent G2 smaller than the first contact extent G1. Furthermore, after the control unit 111 controls the wiping to be performed by using the first contact extent G1 as the contact extent G, when the control unit 111 determines, in accordance with the detected vibration waveform, that air bubbles exist in the pressure chamber 86 or that the number of nozzles 24 (the number of pressure chambers 86) in which the air bubbles develop or increase in the pressure chamber 86 has increased, the control unit 111 may change the contact extent G to a second contact extent G2 smaller than the first contact extent G1.

The first contact extent G1 and the second contact extent G2 are recorded in the memory 117. The second contact extent G2 is recorded as the latest contact extent G. In addition, the tendency of attenuation of the vibration waveform and the frequency of the vibration waveform, which are criteria for determining the first contact extent G1 and the second contact extent G2, are also recorded in the memory 117. As a result, the contact extent can be easily changed so as to improve the wiping performance. Further, since the wiping conditions is set by using the first contact extent G1 as a reference for comparison, the criterion is clarified and the wiping conditions can be set in an effective manner.

Moreover, as the wiping conditions setting process, after the control unit 111 controls the wiping to be performed by using the first contact extent G1 as the contact extent G, when the control unit 111 determines, in accordance with the detected vibration waveform, that the liquid on the nozzle surface 25 is connected with the liquid in the nozzle 24 or that the number of nozzles 24 (the number of pressure chambers 86) in which the liquid on the nozzle surface 25 is are connected with the liquid in the nozzle 24 has increased, the control unit 111 changes the contact extent G to a third contact extent G3 larger than the first contact extent G1. The change from the first contact extent G1 to the third contact extent G3 is performed by operating the contact extent changing unit 110. Specifically, the contact extent changing unit 110 is driven to lower the liquid ejecting head 15 along the Z axis. As a result, the nozzle surface 25 falls with respect to the wiper 100, so that the contact extent G can be increased. For example, by lowering the liquid ejecting head 15 by 0.1 mm along the Z axis, it is possible to change the contact extent G to the third contact extent G3 that is 0.1 mm larger than the first contact extent G1. The first contact extent G1 and the third contact extent G3 are recorded in the memory 117. The third contact extent G3 is recorded as the latest contact extent G. In addition, the tendency of attenuation of the vibration waveform and the frequency of the vibration waveform, which are criteria for determining the first contact extent G1 and the third contact extent G3, are also recorded in the memory 117. As a result, the contact extent can be easily changed so as to improve the wiping performance. Further, since the wiping conditions is set by using the first contact extent G1 as a reference for comparison, the criterion is clarified and the wiping conditions can be set in an effective manner.

Furthermore, as the wiping conditions setting process, after the control unit 111 sets a speed Sp for the relative movement between the wiper 100 and the nozzle surface 25 to a first speed Sp1 and also changes the contact extent G from the first contact extent G1 to the second contact extent G2 or the third contact extent G3, when the control unit 111 determines, in accordance with the detected vibration waveform, that air bubbles increase in the pressure chamber 86, that the number of nozzles 24 having air bubbles in the pressure chamber 86 (the number of pressure chambers 86) has increased, that the liquid on the nozzle surface 25 is connected to the liquid in the nozzle 24, or that the number of nozzles 24 (the number of pressure chambers 86) in which the liquid on the nozzle surface 25 is connected with the liquid in the nozzle 24 has increased, the control unit 111 changes the speed Sp to a second speed Sp2 slower than the first speed Sp1. The change from the first speed Sp1 to the second speed Sp2 is performed by operating the moving unit 101. Specifically, the rotation rate of the motor 102 of the moving unit 101 is decreased. As a result, the speed Sp of the wiper 100 moving relative to the nozzle surface 25 can be slowed down. For example, the speed Sp can be changed to the second speed Sp2, which is 1 mm/s slower than the first speed Sp1.

The first speed Sp1 and the second speed Sp2 are recorded in the memory 117. The second speed Sp2 is recorded as the latest velocity Sp. In addition, the tendency of attenuation of the vibration waveform and the frequency of the vibration waveform, which are criteria for determining the first speed Sp1 and the second speed Sp2, are also recorded in the memory 117. As a result, after the contact extent G is changed, when it is detected that the inner condition of the pressure chambers 86 is defective, the speed Sp for the relative movement during wiping can be optimized to improve the wiping performance.

Figure 9:
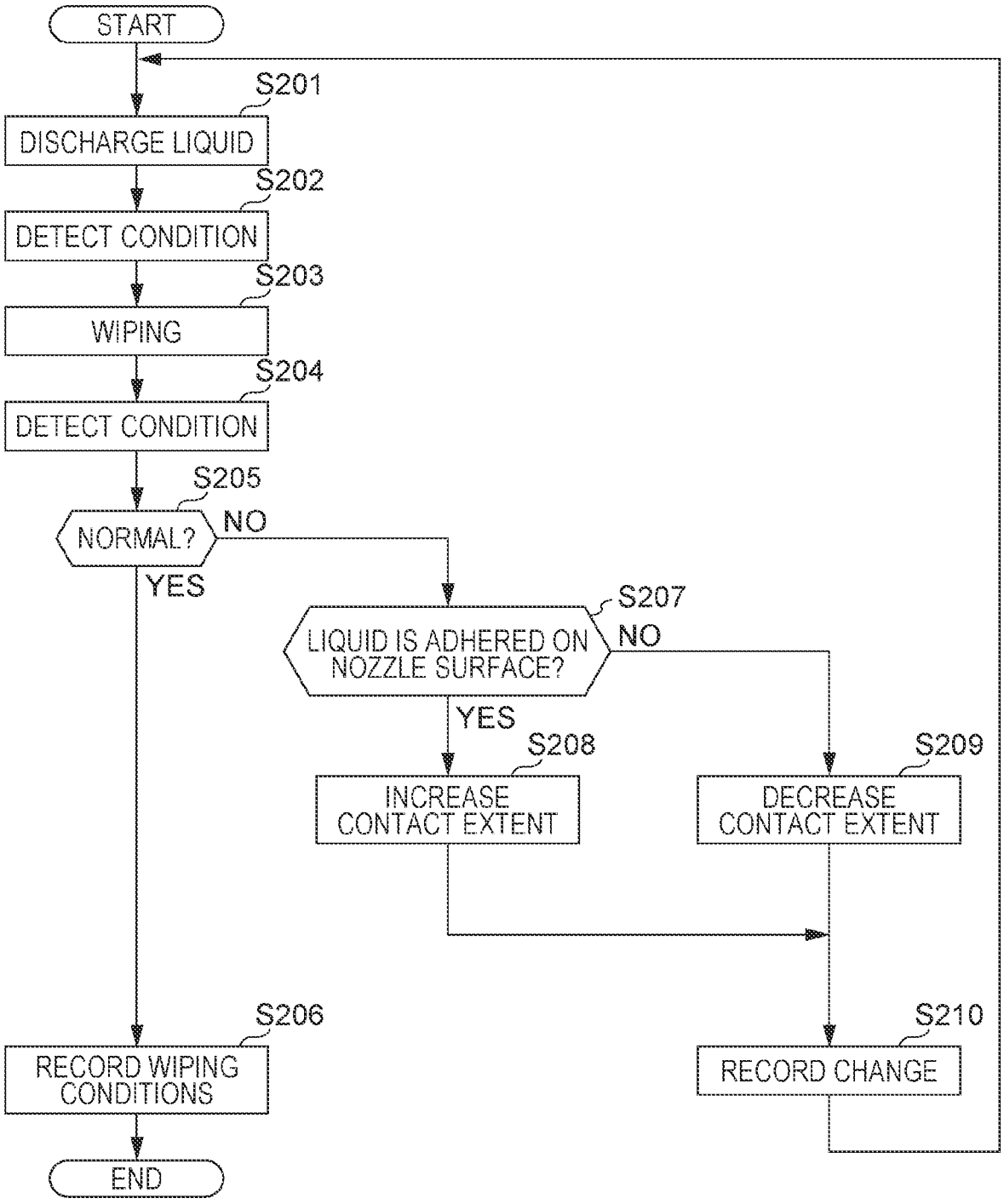
FIG. 9 is a flowchart illustrating a maintenance method with regard to setting of wiping conditions of the liquid ejecting apparatus.

Next, a maintenance method for the liquid ejecting apparatus 11 will be described. In the maintenance method for the liquid ejecting apparatus 11, the wiping conditions for wiping the nozzle surface 25 with the wiper 100 is changed in accordance with the detected inner condition of the pressure chambers 86. First, the maintenance method for setting the wiping conditions will be described below. FIG. 9 is a flowchart illustrating an initial setting operation for the wiping conditions. More specifically, the flowchart illustrates a setting operation for optimizing the contact extent G of the wiping conditions. In the default state of the liquid ejecting apparatus 11 before the initial setting of the wiping conditions, the attenuation and frequency of the standard vibration waveform, the standard contact extent G based on the standard vibration waveform, and the standard speed Sp for wiping are recorded in the memory 117. The standard vibration waveform is set in accordance with the result of prior evaluation or the like. Furthermore, in the default state of the liquid ejecting apparatus 11, the liquid ejecting head 15 is not filled with liquid. Hence, firstly, the inner condition of the pressure chambers 86 is detected in the state in which the liquid ejecting head 15 is filled with liquid by using the wiping conditions of the standard contact extent G based on the standard vibration waveform and the standard speed Sp for wiping; and accordingly, the contact extent G is set to an optimum contact extent. Hereinafter, a specific description will be given.

In step S201, the control unit 111 controls the liquid supply unit 19 to supply liquid to the liquid ejecting head 15 and controls the liquid ejecting head 15 to discharge the liquid from the nozzle 24. For the liquid discharge process from the liquid ejecting head 15, the actuator 89 may be controlled to perform flushing; alternatively, in the state in which the cap 80 caps the liquid ejecting head 15, the suction pump 82 may be controlled to operate so as to forcibly discharge the liquid from the nozzle 24; alternatively, the liquid pressurized by the pressure regulator device 40 may be supplied to the liquid ejecting head 15. The liquid discharge process may be carried out for a predetermined period or a predetermined number of times.

In step S202, the control unit 111 perform control to detect the inner condition of the pressure chamber 86. Specifically, the actuator 89 and the condition detection unit 113 are controlled to operate, so that the vibration waveform in the pressure chamber 86 is detected and data of the detected vibration waveform is obtained. The attenuation and frequency of the vibration waveform obtained in step S202 are within a predetermined range of the attenuation and frequency of the standard vibration waveform unless there is a particular fault with the liquid ejecting head 15.

In step S203, the control unit 111 performs control to carry out wiping. Specifically, the wiper 100 is moved to the liquid ejecting head 15 in the wiping direction Dt and wipes the nozzle surface 25. The wiping is performed by using the standard contact extent G and the standard speed Sp as the wiping conditions.

In step S204, the control unit 111 perform control to detect the inner condition of the pressure chamber 86. Specifically, the actuator 89 and the condition detection unit 113 are controlled to operate, so that the vibration waveform in the pressure chamber 86 is detected and data of the detected vibration waveform is obtained.

In step S205, the control unit 111 determines whether the inner condition of the pressure chamber 86 is normal. Specifically, in accordance with the detection result obtained by the condition detection unit 113, that is, the detected vibration waveform, the control unit 111 determines whether air bubbles exist in the pressure chamber 86, whether air bubbles in the pressure chamber 86 increase, whether the number of pressure chambers 86 containing air bubbles increases, or whether there is liquid connected with the liquid in the nozzle 24. In the present embodiment, the inner condition of the pressure chamber 86 is determined by comparing the vibration waveform detected in step S202 before the wiping process in step S203 and the vibration waveform detected in step S204 after the wiping process in step S203. In this manner, it is possible to accurately determine whether there is an effect of the wiping process. When it is determined that the inner condition of the pressure chamber 86 is normal (YES), the process proceeds to step S206. By contrast, when it is determined that the inner condition of the pressure chamber 86 is abnormal (NO), the process proceeds to step S207.

When the process proceeds to step S206, the control unit 111 controls the memory 117 to record the wiping conditions. In this case, for example, when the contact extent G in step S203 is the first contact extent G1, the memory 117 records the first contact extent G1 as the contact extent G. In addition, when the speed Sp for the wiping in step S203 is the first speed Sp1, the memory 117 records the first speed Sp1 as the speed Sp.

When the process proceeds to step S207, in accordance with the detected vibration waveform, it is determined whether there is liquid adhered to the nozzle surface 25 and connected with the liquid in the nozzle 24. When it is determined that there is liquid on the nozzle surface 25 connected with the liquid in the nozzle 24 (YES), the process proceeds to step S208. When it is determined that there is no liquid on the nozzle surface 25 connected with the liquid in the nozzle 24 (NO), the process proceeds to step S209.

When the process proceeds to step S208, the contact extent G is increased. Specifically, in this case, for example, when the contact extent G in step S203 is the first contact extent G1, the contact extent changing unit 110 is controlled to change the contact extent G to the third contact extent G3 larger than the first contact extent G1. Subsequently, in step S210, the control unit 111 controls the memory 117 to record the third contact extent G3 as a change of the contact extent G. The speed Sp for wiping is maintained at the first speed Sp1.

When the process proceeds to step S209, the contact extent G is decreased. Specifically, the case of NO in step S207 is the case in which it is determined, in accordance with the detected vibration waveform, that air bubbles exist in the pressure chamber 86, more specifically, the case in which it is determined, in accordance with the detected vibration waveform, that air bubbles in the pressure chamber 86 increase, or that the number of pressure chambers 86 containing air bubbles has increased. In this case, for example, when the contact extent G in step S203 is the first contact extent G1, the contact extent changing unit 110 is controlled to change the contact extent G to the second contact extent G2 smaller than the first contact extent G1. Subsequently, in step S210, the control unit 111 controls the memory 117 to record the second contact extent G2 as a change of the contact extent G. The speed Sp for wiping is maintained at the first speed Sp1. Subsequently, the process returns to step S201. Afterwards, the process operations are repeated. As a result, the contact extent can be easily changed so as to improve the wiping performance. Additionally, a criterion of the contact extent G for changing the wiping conditions is clarified, and accordingly, the wiping conditions can be set in an effective manner.

Figure 10:
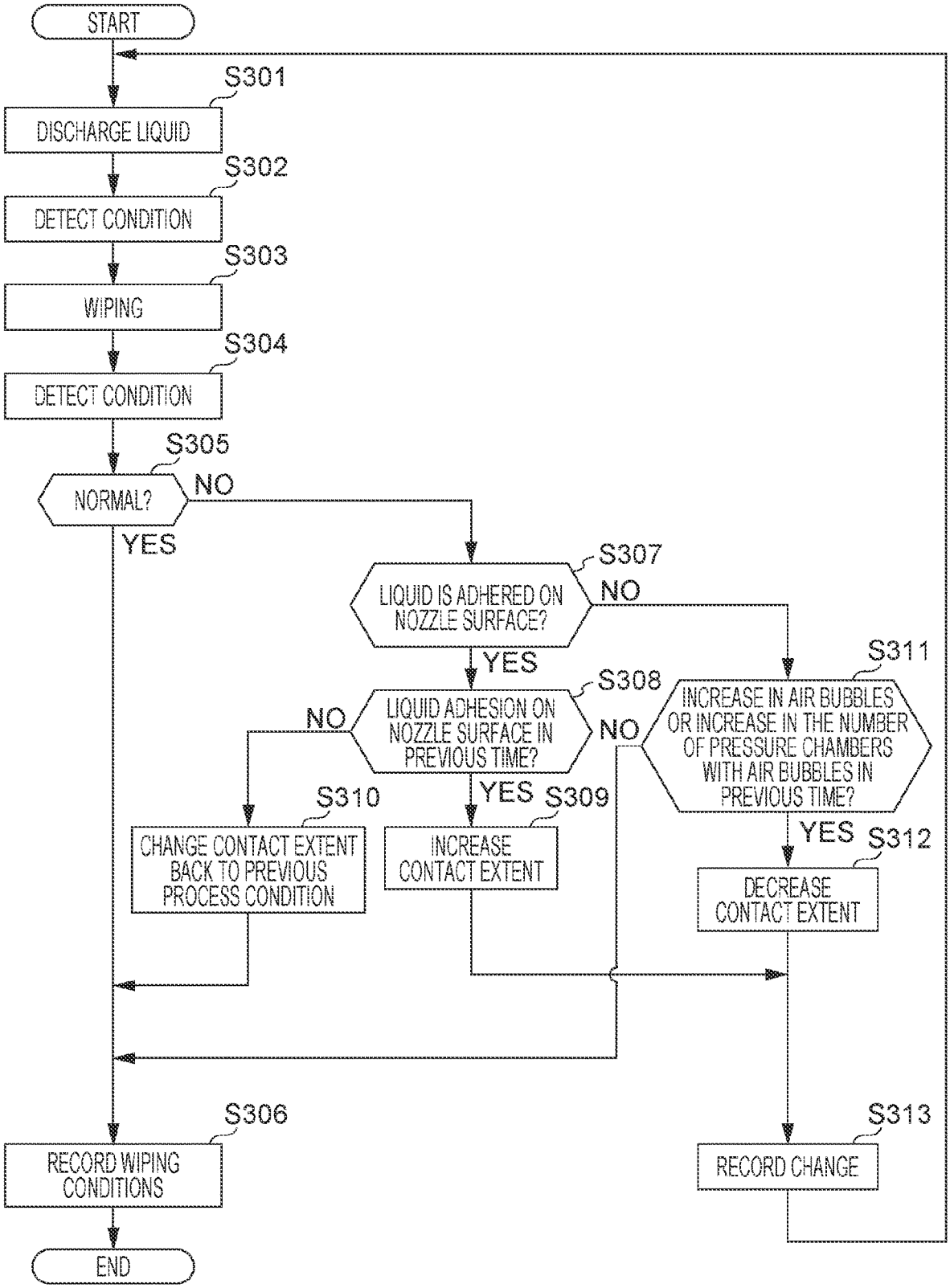
FIG. 10 is a flowchart illustrating a maintenance method with regard to setting of wiping conditions of the liquid ejecting apparatus.

Next, the following description is about a maintenance method as illustrated in FIG. 10 that has been developed in consideration of the tendency of the number of the pressure chambers 86 determined to be abnormal when it is determined whether the inner condition of the pressure chamber 86 is normal or abnormal. It should be noted that, since steps S301 to S307 in FIG. 10 are the same as steps S201 to S207 in FIG. 9, descriptions thereof are omitted.

In step S307, when it is determined that there is liquid on the nozzle surface 25 connected with the liquid in the nozzle 24 (YES), the process proceeds to step S308. When it is determined that there is no liquid on the nozzle surface 25 connected with the liquid in the nozzle 24 (NO), the process proceeds to step S311.

In step S308, it is determined whether there was liquid on the nozzle surface 25 connected with the liquid in the nozzle 24 in the previous process. Specifically, it is determined whether there also was liquid on the nozzle surface 25 connected with the liquid in the nozzle 24 when the same process operation was performed before steps S302 to S304 in the present process. When there also was liquid on the nozzle surface 25 connected with the liquid in the nozzle 24 at the previous time (YES), that is, when there was and is liquid on the nozzle surface 25 connected with the liquid in the nozzle 24 in both the previous process and the present process (YES), the process proceeds to step S309. By contrast, when it is determined that there was no liquid on the nozzle surface 25 connected with the liquid in the nozzle 24 in the previous time (NO), the process proceeds to step S310.

When the process proceeds to step S309, the contact extent G is increased. This means that, since there also is liquid on the nozzle surface 25 connected with the liquid in the nozzle 24 in the present process as in the previous process, it is necessary to further increase the contact extent G. For this reason, for example, when the contact extent G in step S303 of the present process is the first contact extent G1, the contact extent changing unit 110 is controlled to change the contact extent G to the third contact extent G3 larger than the first contact extent G1. Subsequently, the process proceeds to step S313 and the memory 117 records the third contact extent G3 as a change of the contact extent G. The speed Sp for wiping is maintained at the first speed Sp1. Subsequently, the process returns to step S301.

By contrast, when the process proceeds to step S310, since there was no liquid on the nozzle surface 25 connected with the liquid in the nozzle 24 in the previous process, it is necessary to change the contact extent G back to the condition of the previous process. Specifically, when the contact extent G in step S303 of the present process is the first contact extent G1, the contact extent changing unit 110 is controlled to change the contact extent G to the fourth contact extent G4 in the previous time smaller than the first contact extent G1. Subsequently, the process proceeds to step S306 and the control unit 111 controls the memory 117 to record the wiping conditions. In this case, the memory 117 records the fourth contact extent G4 as the contact extent G. In addition, when the speed Sp for the wiping in step S303 is the first speed Sp1, the memory 117 records the first speed Sp1 as the speed Sp.

When the process proceeds to step S311, it is determined whether air bubbles increased in the pressure chamber 86 in the previous process or whether the number of the pressure chambers 86 containing air bubbles increased in the previous treatment. In the case of NO, the process proceeds to step S306 and the control unit 111 controls the memory 117 to record the wiping conditions. In this case, when the contact extent G in step S303 is the first contact extent G1, the memory 117 records the first contact extent G1 as the contact extent G.

By contrast, in the case of YES in step S311, the process proceeds to step S312 and the contact extent G is decreased. This means that, as in the previous process, air bubbles increase in the present process or the number of pressure chambers containing air bubbles increases in the present process, and thus, it is necessary to further decrease the contact extent G. In this case, for example, when the contact extent G in step S303 is the first contact extent G1, the contact extent changing unit 110 is controlled to change the contact extent G to the second contact extent G2 smaller than the first contact extent G1. Subsequently, in step S313, the memory 117 records the second contact extent G2 as a change of the contact extent G. The speed Sp for wiping is maintained at the first speed Sp1. Subsequently, the process returns to step S301. Afterwards, the process operations are repeated. As a result, the contact extent can be easily changed so as to improve the wiping performance. Additionally, a criterion of the contact extent G for changing the wiping conditions is clarified, and accordingly, the wiping conditions can be set in an effective manner.

Next, a maintenance method for the liquid ejecting apparatus 11 including a cleaning process will be described. Specifically, a method of changing the speed Sp of the relative movement between the wiper 100 and the nozzle surface 25 as a wiping condition associated with the cleaning process will be described. The cleaning process of the present embodiment is the same as the maintenance process described above. As illustrated in FIGS. 9 and 10, when the liquid ejecting apparatus 11 prints after the contact extent G is set, for example, a cleaning process such as a flushing process or suction cleaning may be performed during the printing process. After the cleaning process, a wiping process is performed. Thus, the effect of the wiping process after the cleaning process is checked, and if necessary, the speed Sp a wiping condition is changed.

Figure 11:
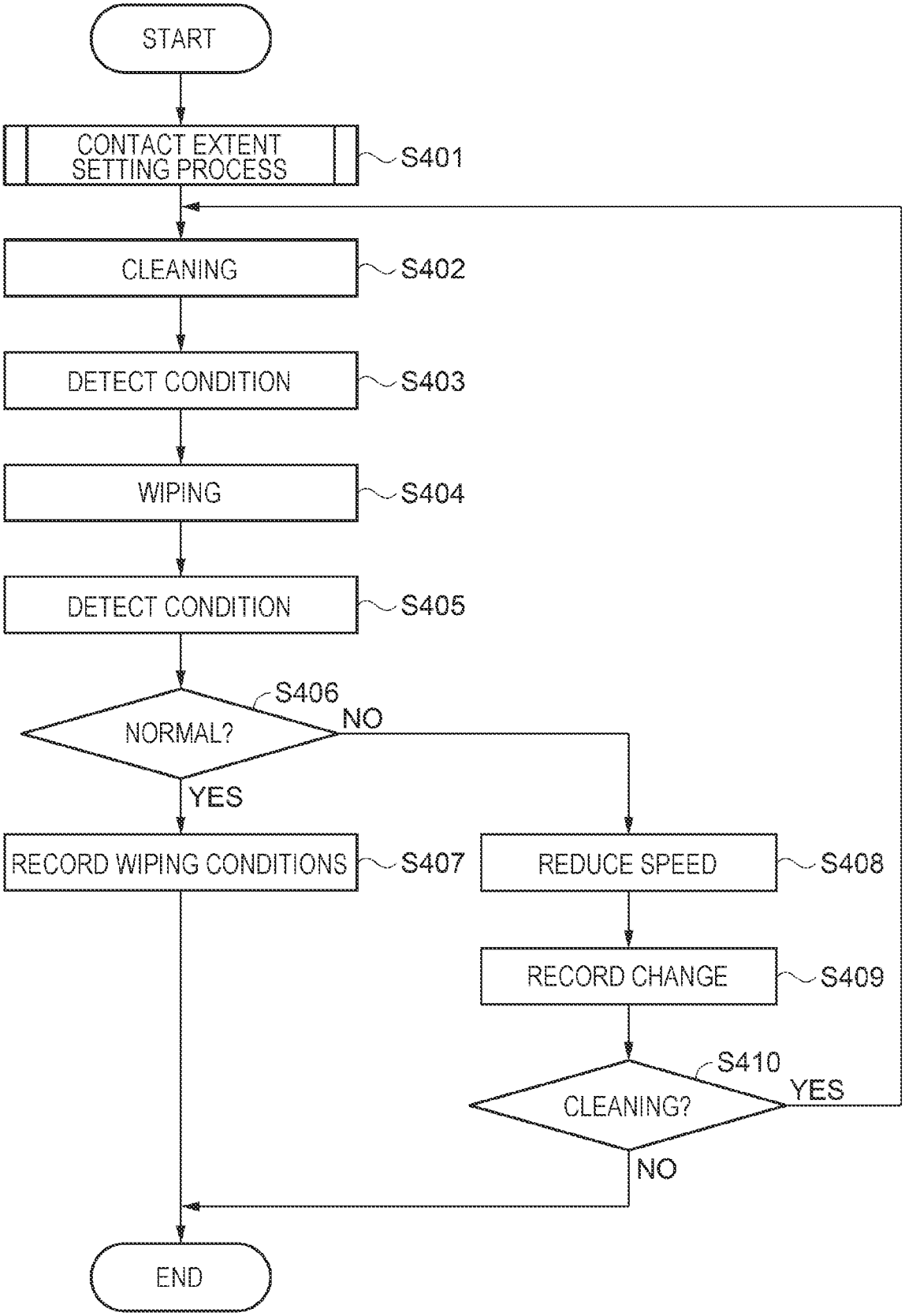
FIG. 11 is a flowchart illustrating a maintenance method with regard to setting of wiping conditions of the liquid ejecting apparatus.

As illustrated in FIG. 11, in step S401, a setting process for the contact extent G is performed. Specifically, the initial setting of the contact extent G of the wiping conditions is performed as in FIGS. 9 and 10. Here, for example, it is assumed that in the initial setting the contact extent G is set to the second contact extent G2 and the speed Sp of the relative movement between the wiper 100 and the nozzle surface 25 is set to the first speed Sp1 in accordance with the attenuation and frequency of the standard vibration waveform.

Next, in step S402, the cleaning process is performed. The control unit 111 specifies details of the cleaning process in accordance with a selection program and performs control to carry out the selected cleaning process. For example, the control unit 111 may control the actuator 89 to perform flushing; alternatively, in the state in which the cap 80 caps the liquid ejecting head 15, the control unit 111 may control the suction pump 82 to operate such that the suction cleaning is performed to forcibly discharging the liquid from the nozzle 24; alternatively, the control unit 111 may perform control to supply the liquid pressurized by the pressure regulator device 40 to the liquid ejecting head 15, which means that the pressure cleaning may be performed.

Next, in step S403, the control unit 111 perform control to detect the inner condition of the pressure chamber 86. Specifically, the actuator 89 and the condition detection unit 113 are controlled to operate, so that the vibration waveform in the pressure chamber 86 is detected and data of the detected vibration waveform is obtained. The attenuation and frequency of the vibration waveform obtained in step S403 are within a predetermined range of the attenuation and frequency of the standard vibration waveform in step S401 unless there is a particular fault with the liquid ejecting head 15. In the following description, it is assumed that the vibration waveform obtained in this step S403 is within the predetermined range.

In step S404, the control unit 111 performs control to carry out wiping. Specifically, the control unit 111 controls the wiper 100 to move to the liquid ejecting head 15 in the wiping direction Dt and wipes the nozzle surface 25. The speed Sp of wiping in the wiping direction Dt is the first speed Sp1.

In step S405, the control unit 111 perform control to detect the inner condition of the pressure chamber 86. Specifically, the actuator 89 and the condition detection unit 113 are controlled to operate, so that the vibration waveform in the pressure chamber 86 is detected and data of the detected vibration waveform is obtained.

In step S406, the control unit 111 determines, in accordance with the obtained vibration waveform, whether the inner condition of the pressure chamber 86 is normal. Specifically, in accordance with the detection result obtained by the condition detection unit 113, that is, the detected vibration waveform, the control unit 111 determines whether air bubbles exist in the pressure chamber 86, whether air bubbles in the pressure chamber 86 increase, or whether there is liquid connected with the liquid in the nozzle 24. In the present embodiment, the change in the inner condition of the pressure chamber 86 is determined by comparing the vibration waveform detected in step S403 before the wiping process in step S404 and the vibration waveform detected in step S405 after the wiping process in step S404. In this manner, it is possible to accurately determine whether there is an effect of the wiping process. When it is determined that there is no increase in air bubbles in the pressure chamber 86 and no increase in the number of pressure chambers 86 containing air bubbles and also that there is no liquid adhered to the nozzle surface 25 and connected with the liquid in the nozzle 24, it is determined that the wiping process has not worsened the inner condition of the pressure chambers 86 and the inner condition of the pressure chambers 86 is normal (YES), and subsequently, the process proceeds to step S407. This means that, when it is determined that the inner condition of the pressure chambers 86 has not been worsened and is normal, it is determined that the wiping speed as the initial wiping condition in step S401 is appropriate for the details of the cleaning process performed in step S402. By contrast, when the control unit 111 determines, in accordance with the detected vibration waveform, that there is an increase in air bubbles in the pressure chamber 86 or an increase in the number of pressure chambers 86 containing air bubbles, or that there is liquid on the nozzle surface 25 connected with the liquid in the nozzle 24, it is determined that the inner condition of the pressure chamber 86 after the wiping process is not normal, that is, abnormal (NO), and the process proceeds to step S408.

When the process proceeds to step S407, the control unit 111 controls the memory 117 to record the wiping conditions. In this case, for example, the memory 117 records the second contact extent G2 and the first speed Sp1 that are the initial wiping conditions.

When the process proceeds to step S408, the speed Sp for wiping is reduced. Specifically, the control unit 111 controls the motor 102 of the moving unit 101 to change the speed Sp to the second speed Sp2 slower than the first speed Sp1. For example, the speed Sp is changed to the second speed Sp2 that is 1 mm/s slower than the first speed Sp1. As a result, after the wiping condition of the contact extent G is initially set, when it is detected that the inner condition of the pressure chambers 86 is defective, the speed Sp for the relative movement during wiping can be optimized to improve the wiping performance.

Next, in step S409, the memory 117 records the second speed Sp2 as a change of the speed Sp. The second contact extent G2 is maintained as the contact extent G.

Next, in step S410, the control unit 111 determines whether to subsequently perform the cleaning process. When it is determined to subsequently perform the cleaning process (YES), the process proceeds to step S402. Conversely, when it is determined that the cleaning process is unnecessary (NO), the process ends.

FIG. 11 illustrates the case in which the vibration waveform detected in step S403 is within a predetermined range of the attenuation and frequency of the standard vibration waveform. Alternatively, after step S403, the process may include a step of comparing the vibration waveform detected in step S403 with the standard vibration waveform set in step S401 to determine whether the inner condition of the pressure chambers 86 is normal. When it is determined that the inner condition of the pressure chamber 86 is normal, the process proceeds to step S404. By contrast, when it is determined that the inner condition of the pressure chamber 86 is abnormal, a process operation of reviewing the conditions of the cleaning process is performed. This method facilitates the determination of whether the cause is the cleaning process or the wiping process. Specifically, when it is determined in step S406 that the inner condition of the pressure chamber 86 is abnormal, it can be clarified that the cause is the wiping process.

Figure 12:
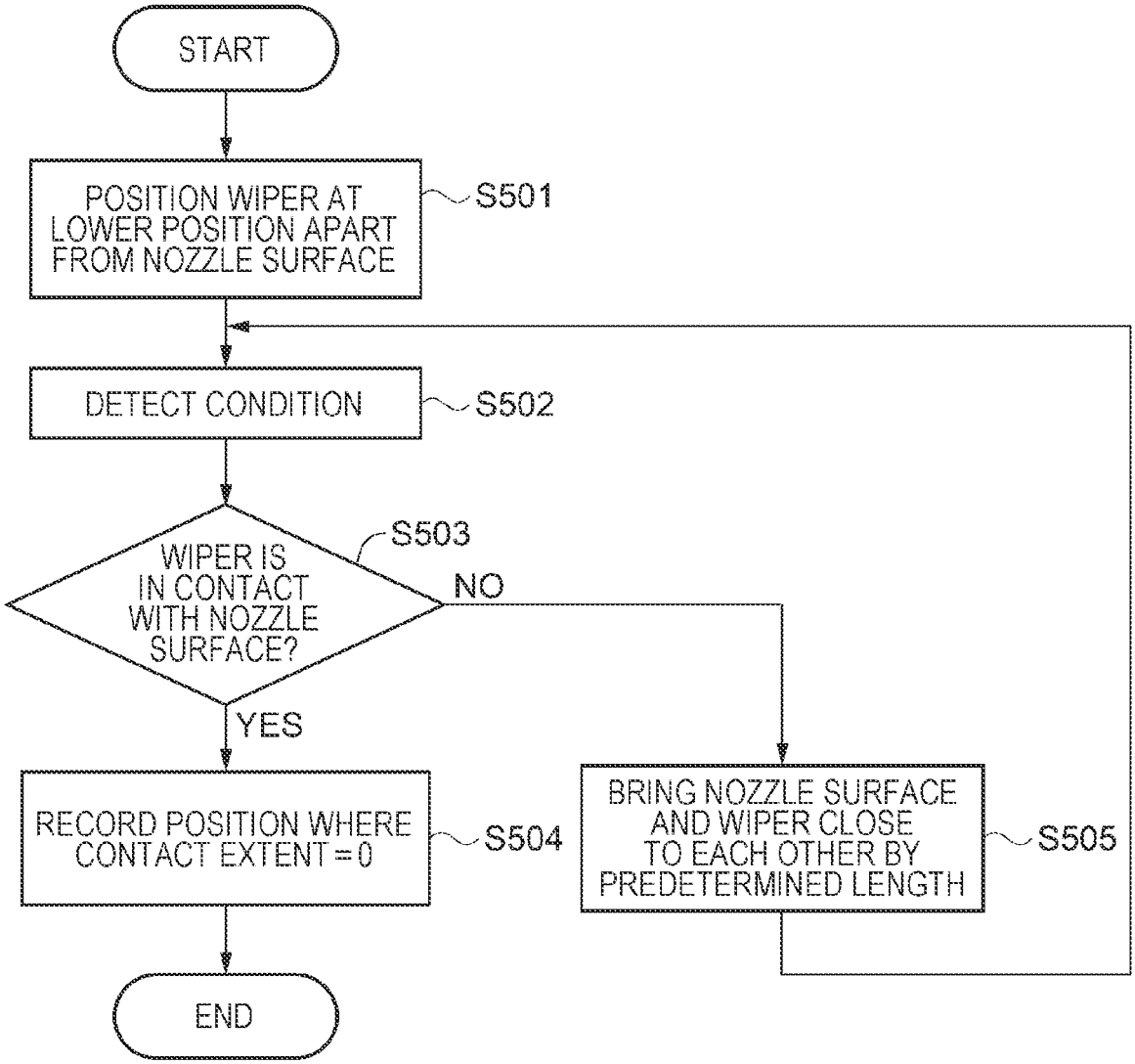
FIG. 12 is a flowchart illustrating a method of setting a reference point of contact extent.
Figure 13A:
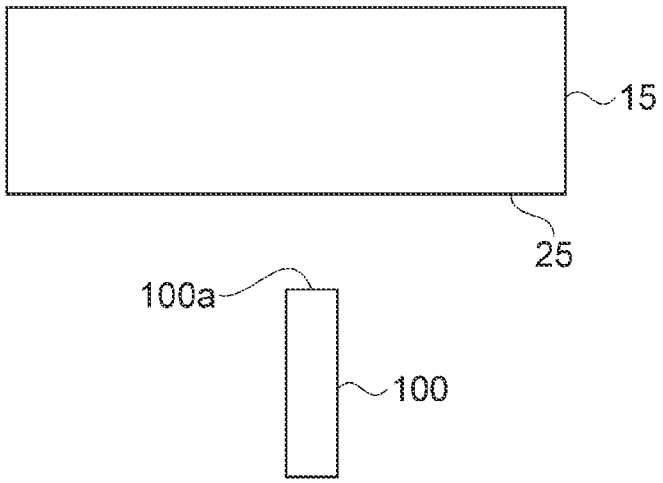
FIG. 13A is a schematic diagram illustrating the method of setting a reference point of contact extent.
Figure 13B:
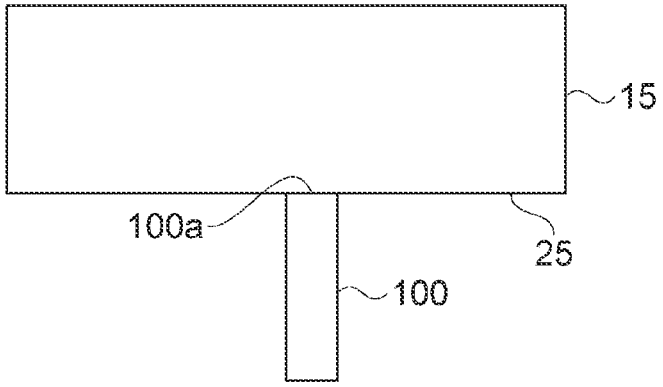
FIG. 13B is a schematic diagram illustrating the method of setting a reference point of contact extent.

Next, a method of setting the contact extent G will be described. Specifically, a method of setting a reference point of the contact extent G will be described. FIG. 12 is a flowchart illustrating the method of setting a reference point of the contact extent G. FIGS. 13A and 13B schematically illustrate the method of setting a reference point of the contact extent G. In the following description, the liquid ejecting head 15 may be filled with liquid or may be empty.

First, in step S501, the wiper 100 is positioned at a lower position apart from the nozzle surface 25. Specifically, as illustrated in FIG. 13A, the control unit 111 controls the contact extent changing unit 110 to move the liquid ejecting head 15 to a position above a distal end portion 100*a* of the wiper 100. Further, the control unit 111 controls the moving unit 101 to move the wiper 100 so as to position the distal end portion 100*a* under the nozzle surface 25. As a result, the nozzle surface 25 and the distal end portion 100*a* of the wiper 100 face each other. In this case, the control unit 111 may control the moving unit 101 to move the wiper 100 so as to position the distal end portion 100*a* under the nozzle surface 25 and under the pressure chambers 86 in the vertical direction.

Next, in step S502, the control unit 111 perform control to detect the inner condition of the pressure chamber 86. Specifically, the actuator 89 and the condition detection unit 113 are controlled to operate, so that the vibration waveform in the pressure chamber 86 is detected and data of the detected vibration waveform is obtained.

Next, in step S503, in accordance with the obtained vibration waveform, the control unit 111 determines whether the nozzle surface 25 and the distal end portion 100*a* of the wiper 100 are in contact with each other. Here, the vibration waveform differs between the case in which the distal end portion 100*a* of the wiper 100 and the nozzle surface 25 are not in contact with each other and the case in which the distal end portion 100*a* of the wiper 100 and the nozzle surface 25 are in contact with each other. Specifically, since a part of the wall surface of the pressure chamber 86 is constituted by the nozzle forming member including the nozzle surface 25 and the nozzle, the attenuation of the vibration waveform is larger when the distal end portion 100*a* of the wiper 100 and the nozzle surface 25 are in contact with each other than when the distal end portion 100*a* of the wiper 100 and the nozzle surface 25 are not in contact with each other. Hence, the control unit 111 determines whether the attenuation of the obtained vibration waveform is larger than the attenuation of the vibration waveform in the non-contact state, and accordingly, the control unit 111 determines whether the nozzle surface 25 and the distal end portion 100*a* of the wiper 100 are in contact with each other. When it is determined that the nozzle surface 25 and the distal end portion 100*a* of the wiper 100 are in contact with each other (YES), the process proceeds to step S504. When it is determined that the nozzle surface 25 and the distal end portion 100*a* of the wiper 100 are not in contact with each other (NO), the process proceeds to step S505. FIG. 13B illustrates the state in which the distal end portion 100*a* of the wiper 100 and the nozzle surface 25 are in contact with each other. In step S503, the control unit 111 may determine whether it is the contact state or the non-contact state by performing comparison with the use of the vibration waveform in the contact state that has been obtained in advance.

When the process proceeds to step S504, a position at which the contact extent G is zero is recorded. Specifically, the control unit 111 controls the memory 117 to record the position of the nozzle surface 25 of the liquid ejecting head 15 determined to be in the contact state as the position at which the contact extent G is zero. To locate the nozzle surface 25 as the position at which the contact extent G is zero, for example, a sensor such as an encoder of any type or the like may be used.

When the process proceeds to step S505, the nozzle surface 25 and the wiper 100 are brought close to each other by a predetermined length. Specifically, the control unit 111 controls the contact extent changing unit 110 to lower the liquid ejecting head 15 with respect to the wiper 100. For example, the liquid ejecting head 15 is lowered by a predetermined length of 0.1 mm with respect to the wiper 100. Subsequently, the process returns to step S502.

Then, in the same manner as described above, in step S502, the inner condition of the pressure chambers 86 is detected. And subsequently, in step S503, in accordance with the obtained vibration waveform, it is determined whether the nozzle surface 25 and the distal end portion 100*a* of the wiper 100 are in contact with each other. Afterwards, the process operations described above are repeated until it is determined that the nozzle surface 25 and the distal end portion 100*a* of the wiper 100 are in contact with each other.

In this manner, the reference point at which the contact extent G is zero is specified, and accordingly, when the contact extent G is set, the contact extent G can be accurately adjusted in accordance with the reference point. In step S505 described above, the inner condition of the pressure chamber 86 is detected after the nozzle surface 25 and the wiper 100 are brought close to each other by a predetermined length. However, this should not be construed in a limiting sense. For example, the inner condition of the pressure chamber 86 may be detected while the nozzle surface 25 is being lowered with respect to the wiper 100. In this manner, the processing time can be shortened.

Hereinafter, other embodiments will be described. The liquid ejecting apparatus 11 may move the liquid ejecting head 15 in the direction in which wiping is performed, such that the wiper 100 and the liquid ejecting head 15 may be relatively moved in the direction in which wiping is performed. For example, when the direction in which wiping is performed is the same as the scan direction Xs, the movement mechanism 16 moves the liquid ejecting head 15 in the direction in which wiping is performed. The contact extent changing unit 110 may change the contact extent of the wiper 100 with respect to the nozzle surface 25 at the time of wiping by driving the motor to move the wiper 100 up and down along the Z axis. The default set value of the contact extent G of the wiping conditions may differ in accordance with the cleaning previously performed. For example, the default set value of the contact extent G may be 0.7 mm when flushing cleaning is previously performed, 1 mm when suction cleaning is previously performed, and 1.2 mm when pressure cleaning is previously performed. The default set value of the wiping speed, which is the speed of relative movement between the wiper 100 and the nozzle surface 25, may differ in accordance with the cleaning previously performed. For example, the default set value of the wiping speed may be 20 mm/s when flushing cleaning is previously performed, 15 mm/s when suction cleaning is previously performed, and 10 mm/s when pressure cleaning is previously performed. The wiping speed when the contact extent G of the wiping conditions is optimized may be slower than the standard speed or the default set value. For example, the wiping conditions may include the inclination of the wiper 100 with respect to the nozzle surface 25. Specifically, the inclination of the distal end portion 100*a* of the wiper 100 that intersects the wiping direction Dt may be adjusted. In this case, the inclination of the distal end portion 100*a* of the wiper 100 is adjusted to bring both ends of the distal end portion 100*a* of the wiper 100 that intersects the wiping direction Dt into contact with the nozzle surface 25. For example, by operating the condition detection unit 113, the vibration waveform when one end of the distal end portion 100*a* is in contact with the nozzle surface 25 and the vibration waveform when both ends of the distal end portion 100*a* are in contact with the nozzle surface 25 are compared to each other, and accordingly, both ends of the wiper 100 can be adjusted so as to come into contact with the nozzle surface 25. As a result, it is possible to improve the wiping efficiency of the wiper 100 with respect to the nozzle surface 25.

Furthermore, the wiping conditions may include the number of times that the wiper 100 wipes the nozzle surface 25. For example, as a result of detecting the inner condition of the pressure chamber 86 after wiping, when the inner condition of the pressure chamber 86 is determined to be abnormal, the number of times of wiping may be increased. In this manner, the wiping conditions can be optimized.

Further, the wiping conditions may include the amount of supplied cleaning liquid to be applied to the nozzle surface 25 when the nozzle surface 25 is wiped. For example, in FIG. 11, after the speed Sp for wiping is changed to a slowest speed, when the inner condition of the pressure chambers 86 is determined to be abnormal as a result of detecting the inner condition of the pressure chambers 86 after wiping, the amount of supplied cleaning liquid may be reduced or supplying the cleaning liquid may be stopped. In this manner, the wiping conditions can be optimized.

Moreover, the wiping conditions may include the pressure force applied to the liquid toward the liquid ejecting head 15 by the pressure regulator device 40 in the cleaning process. For example, when it is determined, in accordance with the detected vibration waveform, that there is liquid adhered to the nozzle surface 25 and connected with the liquid in the nozzle 24, the pressure force to the liquid applied by the pressure regulator device 40 is decreased. Conversely, when it is determined, in accordance with the detected vibration waveform, that the pressure chamber 86 contains air bubbles, the pressure force to the liquid applied by the pressure regulator device 40 is increased. In this manner, the wiping conditions can be optimized. The wiping conditions described above may be combined together as appropriate.

While the liquid ejecting head 15 is configured to eject the liquid in the pressure chamber 86 as droplets by operating the actuator 89, the present disclosure is not limited to this configuration. For example, the liquid ejecting head 15 may be configured to eject the liquid from the nozzle 24 communicating with the pressure chamber 86 by heating the liquid in the pressure chamber 86 with the use of an electricity-heat conversion element (heater) to cause film boiling. In this case, the condition detection unit 113 compares a highest temperature when liquid is ejected, which is detected by a temperature detection element provided directly under the heater, with a predetermined threshold. When the highest temperature is higher than the temperature during normal ejection, the condition detection unit 113 may determine that air bubbles exist in the pressure chamber 86. When the temperature drops from the highest temperature earlier than the case of normal ejection, the condition detection unit 113 may determine that liquid is adhered to the nozzle surface 25.

What is claimed is:

1. A liquid ejecting apparatus comprising:

a liquid ejecting head having a nozzle surface and configured to eject liquid from a nozzle formed at the nozzle surface;

a wiper configured to perform wiping with respect to the nozzle surface;

a contact extent changing unit configured to change a contact extent of the wiper with respect to the nozzle surface;

a moving unit configured to relatively move the wiper and the nozzle surface in a direction in which the wiping is performed;

a condition detection unit configured to detect an inner condition of a pressure chamber communicating with the nozzle; and a control unit configured to, after controlling the wiping to be performed by using a first contact extent as a contact extent, when determining, in accordance with the inner condition of the pressure chamber, that the liquid on the nozzle surface is connected with the liquid in the nozzle, change the contact extent to a large contact extent larger than the first contact extent by operating the contact extent changing unit.

2. The liquid ejecting apparatus according to claim 1, wherein the control unit is configured to, after controlling the wiping to be performed by using the first contact extent as the contact extent, when determining, in accordance with the inner condition of the pressure chamber, that an air bubble exists in the pressure chamber, change the contact extent to a small contact extent smaller than the first contact extent.

3. The liquid ejecting apparatus according to claim 2, wherein the condition detection unit is configured to detect the inner condition of the pressure chamber by detecting a vibration waveform of the pressure chamber vibrating due to an operation of an actuator.

4. The liquid ejecting apparatus according to claim 3, wherein the control unit is configured to, after setting a first speed as a speed for relatively moving the wiper and the nozzle surface and changing the contact extent to the small contact extent or the large contact extent, when determining, in accordance with the vibration waveform, that the air bubble exists in the pressure chamber or that the liquid on the nozzle surface is connected with the liquid in the nozzle, change the speed to a second speed slower than the first speed.

5. The liquid ejecting apparatus according to claim 1, wherein the condition detection unit is configured to detect the inner condition of the pressure chamber both before and after the wiper performing wiping.

6. The liquid ejecting apparatus according to claim 1, wherein the condition detection unit is configured to detect the inner condition of the pressure chamber by detecting a vibration waveform of the pressure chamber vibrating due to an operation of an actuator.

7. A maintenance method for a liquid ejecting apparatus including a liquid ejecting head having a nozzle surface and configured to eject liquid from a nozzle formed at the nozzle surface and a wiper configured to perform wiping with respect to the nozzle surface, the maintenance method comprising:

after controlling the wiping to be performed by using a first contact extent as a contact extent, when determining, in accordance with an inner condition of a pressure chamber communicating with the nozzle, that the liquid on the nozzle surface is connected with the liquid in the nozzle, changing the contact extent to a large contact extent larger than the first contact extent by operating the contact extent changing unit.

8. The maintenance method for the liquid ejecting apparatus according to claim 7, further comprising:

after controlling the wiping to be performed by using the first contact extent as the contact extent, when determining, in accordance with the inner condition of the pressure chamber, that an air bubble exists in the pressure chamber, changing the contact extent to a small contact extent smaller than the first contact extent.

9. The maintenance method for the liquid ejecting apparatus according to claim 8, further comprising:

detecting the inner condition of the pressure chamber by detecting a vibration waveform of the pressure chamber vibrating due to an operation of an actuator.

10. The maintenance method for the liquid ejecting apparatus according to claim 9, further comprising:

after setting a first speed as a speed for relatively moving the wiper and the nozzle surface in a direction in which the wiping is performed and changing the contact extent to the small contact extent or the large contact extent, when determining, in accordance with the vibration waveform, that the air bubble exists in the pressure chamber or that the liquid on the nozzle surface is connected with the liquid in the nozzle, changing the speed to a second speed slower than the first speed.

11. A liquid ejecting apparatus comprising:

a liquid ejecting head having a nozzle surface and configured to eject liquid from a nozzle formed at the nozzle surface;

a wiper configured to perform wiping with respect to the nozzle surface;

a contact extent changing unit configured to change a contact extent of the wiper with respect to the nozzle surface;

a moving unit configured to relatively move the wiper and the nozzle surface in a direction in which the wiping is performed;

a condition detection unit configured to detect an inner condition of a pressure chamber communicating with the nozzle; and a control unit configured to change the contact extent by operating the contact extent changing unit in accordance with the inner condition of the pressure chamber detected by the condition detection unit, wherein the control unit is configured to determine whether the nozzle surface becomes in contact with the wiper according to the inner condition of the pressure chamber.

12. The liquid ejecting apparatus according to claim 11, wherein the control unit is configured to determine whether the nozzle surface becomes in contact with the wiper while decreasing a gap between the nozzle surface and the wiper.

* * * * *